US010487512B2

(12) United States Patent
Bourque

(10) Patent No.: US 10,487,512 B2
(45) Date of Patent: Nov. 26, 2019

(54) ROOF VENT WITH INTEGRATED SHIELD

(71) Applicant: SNOWVENTCO LIMITED, Foxboro (CA)

(72) Inventor: Antoine Bourque, Foxboro (CA)

(73) Assignee: SNOWVENTCO LIMITED, Foxboro (CA)

( * ) Notice: Subject to any disclaimer, the term of this patent is extended or adjusted under 35 U.S.C. 154(b) by 0 days.

(21) Appl. No.: 15/980,039

(22) Filed: May 15, 2018

(65) Prior Publication Data

US 2018/0328041 A1 Nov. 15, 2018

Related U.S. Application Data

(60) Provisional application No. 62/506,122, filed on May 15, 2017.

(51) Int. Cl.
*E04D 13/17* (2006.01)
*F24F 7/02* (2006.01)
*E04D 1/30* (2006.01)

(52) U.S. Cl.
CPC ..... *E04D 13/174* (2013.01); *F24F 7/02* (2013.01); *E04D 2001/309* (2013.01)

(58) Field of Classification Search
CPC ..... E04D 13/174; E04D 2001/309; F24F 7/02
See application file for complete search history.

(56) References Cited

U.S. PATENT DOCUMENTS 3,238,862 A * 3/1966 Smith ..... F24F 7/02 454/366
5,053,266 A * 10/1991 Hesketh ..... E04D 1/30 428/137
5,591,080 A * 1/1997 Ward ..... F24F 7/02 454/359
5,675,940 A * 10/1997 Bahar ..... E04D 13/031 52/200
6,155,008 A * 12/2000 McKee ..... E04D 13/0325 52/198
6,212,834 B1 * 4/2001 Lindgren ..... E04D 13/031 52/200
6,354,046 B1 * 3/2002 Swearingen ..... E04D 13/0315 52/200
6,951,081 B2 * 10/2005 Bonshor ..... H02G 3/088 52/302.1

(Continued)

OTHER PUBLICATIONS

International Search Report & Written Opinion, dated Sep. 17 2018, in PCT Application No. PCT/CA2018/00096.

*Primary Examiner* — Rodney Mintz

(57) ABSTRACT

A roof vent for ventilating a roof of a building via a hole in the roof to atmosphere, the roof vent comprising: a flange portion for resting on the roof, the flange portion having an opening for overlapping with the hole; a frame portion for maintaining a cap in a spaced apart relationship with the flange portion; the cap connected to the frame portion and covering over the opening; and an integrated shield mounted on the flange portion and extending transverse to the flange portion on a side of the flange portion configured for facing a peak of the roof, the integrated shield spaced apart from the frame portion by a predefined distance and for deflecting water running down the roof to either side of the roof vent.

16 Claims, 24 Drawing Sheets

(56) References Cited

U.S. PATENT DOCUMENTS

| | | | | |
|---|---|---|---|---|
| 7,721,493 | B2 * | 5/2010 | Skov | E04D 13/03 52/200 |
| 7,752,814 | B2 * | 7/2010 | Bonshor | E04F 13/0864 52/60 |
| 7,882,670 | B2 | 2/2011 | West | |
| 8,205,401 | B2 * | 6/2012 | Ward | F24F 7/02 454/367 |
| 8,881,468 | B2 * | 11/2014 | McMullen | E06B 1/62 248/224.8 |
| 9,316,001 | B2 * | 4/2016 | King | E04D 13/1475 |
| 9,457,304 | B2 * | 10/2016 | Bourque | F24F 12/006 |
| 10,018,368 | B2 * | 7/2018 | Bourque | F24F 7/02 |
| 2003/0136060 | A1 * | 7/2003 | Bonshor | H02G 3/088 52/97 |
| 2005/0130581 | A1 * | 6/2005 | Dodge | F24F 7/02 454/366 |
| 2005/0233691 | A1 * | 10/2005 | Horton | E04D 13/17 454/366 |
| 2006/0213132 | A1 * | 9/2006 | Bonshor | E04F 13/0864 52/97 |
| 2006/0230694 | A1 * | 10/2006 | Skov | E04D 3/32 52/200 |
| 2010/0257798 | A1 * | 10/2010 | Ward | F24F 7/02 52/301 |
| 2013/0115871 | A1 * | 5/2013 | Bourque | F24F 7/02 454/365 |
| 2015/0167992 | A1 * | 6/2015 | Bourque | F24F 7/02 454/365 |
| 2015/0275522 | A1 * | 10/2015 | King | E04D 13/1475 52/200 |
| 2015/0321131 | A1 * | 11/2015 | Bourque | F24F 12/006 52/199 |
| 2017/0051930 | A1 | 2/2017 | Bourque et al. | |

* cited by examiner

ROOF VENT WITH INTEGRATED SHIELD

CROSS-REFERENCE TO RELATED APPLICATIONS

This application claims priority to U.S. Provisional Patent Application No. 62/506,122, filed on May 15, 2017; the entire contents of which are hereby incorporated by reference herein.

FIELD

This disclosure relates generally to roof vents for venting the roof of a building such as a house.

BACKGROUND

Roof vents provide the necessary ventilation to the roof of a house or other building, inhibiting condensation in the roof due to the infiltration or otherwise collection of moisture into the roof or attic cavity. Various roof vents employ vanes, grates and louvers to permit air to be channeled between the roof and the atmosphere, and to try to inhibit rain from entering the roof through the roof vent. A variety of caps and covers have been used to act as a guard to prevent the infiltration of rain. However, prior art roof vents have thus far been ineffective in inhibiting the infiltration of water into the attic space, particularly in cases of fierce storms and the like.

Of particular concern for roof mounted vents is the infiltration of water. Roof vents mounted lower down on the roof, nearer the eves, can be particularly susceptible to fast/voluminous moving water coming down the roofing surface and impacting the sides of the roof vent. It is recognized that the greater the speed and/or volume of water impacting the sides of the roof vent, the greater the risk of water infiltrating the roof vent and finding its way in to the interior of the roof. Also of concern is the positioning of multiple auxiliary structures on the roof, such as vents, as the auxiliary structures must be tied into the roof cladding (e.g. shingles), and as such can present potential weaknesses in the roof cladding. Further, care must be taken by installers with the individually positioned auxiliary structures, as each auxiliary structure must be tied in properly with the roof cladding about the auxiliary structure. As the number of individual auxiliary structures increases, the amount of time and expense for installation also increases. Further, some roof geometries present limited space opportunities for the positioning of the auxiliary structures.

As such, it is recognized for any or all of the disadvantages above, minimizing the number of auxiliary structures mounted on a roof surface is preferred.

SUMMARY

It is an object of the present invention to provide a roof vent that obviates or mitigates at least some of the above-presented disadvantages in the art.

An improved roof vent which facilitates adequate attic ventilation but at the same time inhibits the infiltration of snow particles, water droplets, water runoff of the roof surface, burning cinders, and/or other undesirable elements from the atmosphere from gaining entry into the roof via the roof vent is desired.

A first aspect provided is a roof vent for ventilating a roof of a building via a hole in the roof to atmosphere, the roof vent comprising: a flange portion for resting on the roof, the flange portion having an opening for overlapping with the hole; a frame portion for maintaining a cap in a spaced apart relationship with the flange portion; the cap connected to the frame portion and covering over the opening; and a corrugated or non-corrugated filter plate extending between the cap and the flange portion and interposed transversely between the opening and the atmosphere, the corrugated or non-corrugated filter plate providing for a passage of air between the atmosphere and the opening, the corrugated or non-corrugated filter plate having a pore size sufficient for facilitating the air passage of air through the corrugated or non-corrugated filter plate while blocking passage of water through the corrugated or non-corrugated filter plate.

A second aspect provided is a roof vent for ventilating a roof of a building via a hole in the roof to atmosphere, the roof vent comprising: a flange portion for resting on the roof, the flange portion having an opening for overlapping with the hole; a frame portion for maintaining a cap in a spaced apart relationship with the flange portion; the cap connected to the frame portion and covering over the opening; an integrated shield mounted on the flange portion and extending transverse to the flange portion on a side of the flange portion configured for facing a peak of the roof, the integrated shield spaced apart from the frame portion by a predefined distance and for deflecting water running down the roof to either side of the roof vent; and a corrugated or non-corrugated filter plate extending between the cap and the flange portion and interposed transversely between the opening and the atmosphere, the corrugated or non-corrugated filter plate providing for a passage of air between the atmosphere and the opening, the corrugated or non-corrugated filter plate having a pore size sufficient for facilitating the air passage of air through the corrugated or non-corrugated filter plate while blocking passage of water through the corrugated or non-corrugated filter plate.

A third aspect provided is a roof vent for ventilating a roof of a building via a hole in the roof to atmosphere, the roof vent comprising: a flange portion for resting on the roof, the flange portion having an opening for overlapping with the hole; a frame portion for maintaining a cap in a spaced apart relationship with the flange portion; the cap connected to the frame portion and covering over the opening; and an integrated shield mounted on the flange portion and extending transverse to the flange portion on a side of the flange portion configured for facing a peak of the roof, the integrated shield spaced apart from the frame portion by a predefined distance and for deflecting water running down the roof to either side of the roof vent.

BRIEF DESCRIPTION OF THE DRAWINGS

The foregoing and other aspects will now be described by way of example only with reference to the attached drawings, in which.

In the drawings like characters of reference indicate corresponding parts in the different figures.

DETAILED DESCRIPTION

Figure 1:
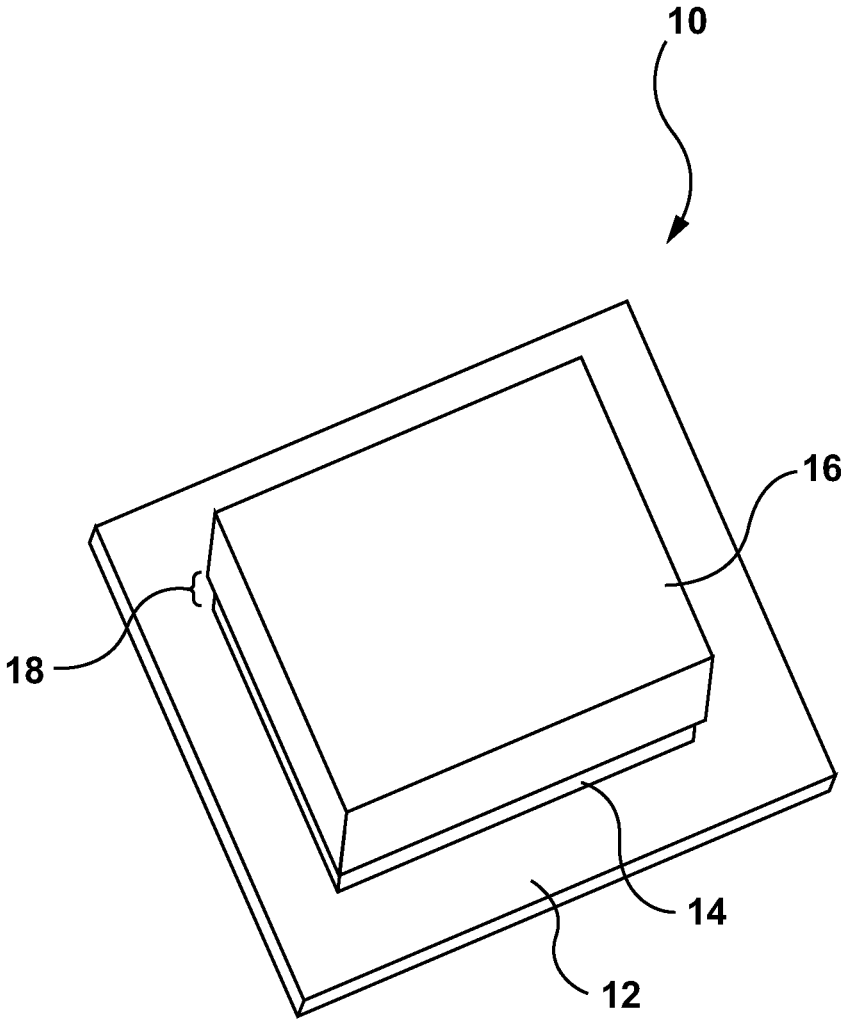
FIG. 1 is a perspective view of a roof vent.

FIG. 1,3 show a roof vent 10 for ventilating the roof of a building to the atmosphere. The roof vent 10 includes a flange portion 12 to lay against the roof, the flange portion 12 having an opening 22 to let air vent from the interior of the building (e.g. an attic). The roof vent 10 can optionally include a collar portion 14 extending from the flange portion 12 and enclosing, at least in part, about a periphery of the opening 22, and a cap 16 dimensioned and configured to cover over the opening 22 (including the hole 28 in the roof) and optionally over the collar portion 14. The cap 16 is configured to provide a passage (between the flange portion 12 and the cap 16) through which air can pass between the atmosphere and the opening 22. The roof vent 10 also includes a corrugated filter plate 46, e.g. partially enclosed by the cap 16, and interposed between the central opening 22 and the air passage (e.g. gap) between the cap 16 and the flange portion 12. The corrugated filter plate 46 can have a pore size 47 (e.g. perforations, holes, a plurality of apertures, etc.—see FIG. 7) sufficient to facilitate air to pass through the corrugated filter material 46 (e.g. from one side 19 of the corrugated filter material 46 to the other 19) but inhibit the passage of snow particles, cinder particles, running water and/or water droplets there-through (e.g. from one side 19 of the corrugated filter material 46 to the other 19). In any event, it is recognized that the purpose of the corrugated filter material 46 is to provide for the flow through of air while inhibiting the passage of undesirable particles/droplets (e.g. solid and/or liquid pieces of matter) through the corrugated filter material 46 impinging from the atmosphere and into the interior of the roof via the opening 22 and adjacent hole 28.

For example, the corrugated filter material 46 can be positioned as extending upwardly between the flange portion 12 and the cap 16 (covering the opening 22). It is recognized that the corrugated filter material 46 can be in contact with a top surface 13 of the flange portion 12, in contact with an underside surface 17 of the cap 16, and/or in contact with the top surface 13 of the flange portion 12 and with the underside surface 17 of the cap 16. It is recognized that a sidewall 15 (e.g. collar wall—see FIG. 2) extending upwardly from the top surface 13 of the flange portion 12 can also be considered as part of the top surface 13 of the flange portion 12. It is recognized that a sidewall (not shown) extending downwardly from the bottom/underside surface 17 of the cap 16 can also be considered as part of the bottom/underside surface 17 of the cap 16.

Corrugated (see FIG. 7) can refer to draws or bends into folds or alternate furrows and ridges of the surface of the filter plate 46. A corrugated surface can also refer to a pleated surface 19. A corrugated surface 19 can also refer to a shape into folds or parallel and alternating ridges and grooves. The juncture between the folds can be well defined (e.g. a crease line) or can be distributed over the surface (e.g. an arcuate change in direction from one fold to the next, such as an arcuate portion of the surface 19 of the corrugated filter material 46). For example, the corrugated filter material 46 (e.g. plate) can be a single walled surface 19 as shown, can be a double walled structure, not shown, (e.g. having a space between adjacent walls having a corrugated surface 19, etc). Preferably the corrugated filter material 46 has a corrugated surface 19 exposed to the passage of air impinging on the corrugated filter material 46 from the atmosphere and directed towards the opening 22 (and overlapping hole 28 in the roof membrane of the building) and into the roof cavity (e.g. attic space). Preferably the corrugated filter material 46 has a corrugated surface 19 exposed to the passage of air impinging on the corrugated filter material 46 from the exiting the roof cavity (e.g. attic space) and directed towards the opening 22 (and overlapping hole 28 in the roof membrane 50 of the building) and into the atmosphere.

In terms of positioning of the corrugated filter material 46 with respect to the cap 16 (at least covering the opening 28) and with respect to the flange portion 12, the corrugated filter material 46 is positioned transverse to both of the cap 16 (e.g. underside surface 17 of the cap 16) and the flange portion 12 (e.g. upper surface 13 of the flange portion 12). As such, it is recognized that the corrugated filter material 46 can be in contact with one of the surfaces 13, 17, with both of the surfaces 13, 17, an/or in contact with none of the surfaces 13, 17 (e.g. suspended between the surfaces 13, 17 by a secondary structure that can also be used to position the cap 16 in a spaced apart relationship with the flange portion 12. For example, the secondary structure can be provided by the collar portion 14 described herein as an example only. In any event, the corrugated filter material 46 extends transversely (in whole, in part, etc.) between the cap 16 and the flange portion 12 (e.g. base of the roof vent 10). In terms of in-whole, then any passage of air between the opening 22 and the atmosphere would pass though the body of the corrugated filter material 46. Alternatively, in terms of in-part, some of the passage of air between the opening 22 and the atmosphere would pass though the body of the corrugated filter material 46 and passage of air between the opening 22 and the atmosphere would go around the body of the corrugated filter material 46. In terms of transverse, this can be referred to as situated or lying across (e.g. between the opposing surfaces 13, 17), lying sideways (e.g. between the opposing surfaces 13, 17), crosswise (e.g. between the opposing surfaces 13, 17), crossing from side to side (e.g. between the opposing surfaces 13, 17), athwart (e.g. between the opposing surfaces 13, 17), crossways (e.g. between the opposing surfaces 13, 17), lying or extending across or in a cross direction (e.g. between the opposing surfaces 13, 17), cross (e.g. between the opposing surfaces 13, 17). One example of transverse (e.g. between the opposing surfaces 13, 17) can be lying at right angles to or perpendicular to each or both of the opposing surfaces 13, 17). It is also recognized that the angle of the corrugated filter material 46, when extending away from (either in or out of contact with the actual surface 13, 17) the surface 13, 17, can be other than 90 degrees, as desired.

The roof vent 10 can be considered as a roof vent type for natural ventilation, as using the process of supplying and removing air through an indoor space (e.g. attic) without using mechanical systems. Natural ventilation implemented by the roof vent 10 can refer to the flow of external air to an indoor space as a result of pressure or temperature differences. There can be two types of natural ventilation occurring in buildings: wind driven ventilation and buoyancy-driven ventilation. While wind can be the main mechanism of wind driven ventilation, buoyancy-driven ventilation can occur as a result of the directional buoyancy force that results from temperature differences between the interior and exterior of the building. Alternatively, natural ventilation can be referred to as Passive ventilation, as a way to provide attic ventilation for shingle roof assemblies is by nonpowered, passive ventilation based roof vent 10. This method relies primarily on natural air convection—the upward movement of heated air because of its lower density—but may also take advantage of wind-generated pressure differences.

Natural convection can initiate the upward flow of air through an attic and through the roof vent 10. This air current can be maintained to aid in continuous circulation of air through the attic if intake vents placed low in the attic make colder air available to replace the heated air exhausted through vents placed high in the attic. Convection-assisted ventilation can be effective when approximately equal amounts of ventilation opening areas are placed at the soffits or eave and at or near the top of the attic space, referred to as "balanced ventilation." It is also recognized that the roof vent 10 can be a powered type roof vent rather than a passive type. For example, the roof vent 10 can have a powered unit, e.g. a fan with corresponding drive mechanism (e.g. motor) for assisting flow of the passage of air through the corrugated filter plate 46.

In terms of the net free cross sectional area for the passage of air through the corrugated filter plate 46, the aggregate total open area (e.g. summation of the effective open area of each of the individual pore 47 cross sectional areas) of the plurality of holes/pores 47 can be configured to satisfy a minimum net open area threshold. For example, the open area threshold can be approximately 50 square inches of flow ability (e.g. net free area) available for the passage of air to flow through. It is recognized that the minimum net open area threshold can be a standard defined threshold, different for each country, province, and/or state based building codes/standards. In an example where the corrugated filter plate 46 does not extend from surface 13 to surface 17, the total net free air flow area available would be the aggregate of the effective open area of each of the individual pore 47 cross sectional areas of the corrugated filter plate 46 and the open cross sectional area of an air gap between an end of the filter plate 46 and the adjacent surface 13, 17.

Referring to FIG. 1,3, the roof vent 10 provides for roof ventilation while at the same time inhibiting the infiltration of snow, water (e.g. undesired particles and/or a series of streaming water) into the attic. The roof vent 10 has the flange portion 12, optionally the collar portion 14 (shown as an example embodiment) and the cap 16 configured to cover over (e.g. most) of the collar portion 14 and to cover over a portion of the surface 19. Flange portion 12 is preferably flat to rest flush with the roof (not shown) to make it easy to install the roof vent. Collar portion 14 extends perpendicularly upward from flange 12. Cap 16 is dimensioned to enclose much of the collar portion 14 but to leave a space gap 18 between the cap 16 and flange portion 12 to permit atmospheric air to pass through collar portion 14.

Figure 2:
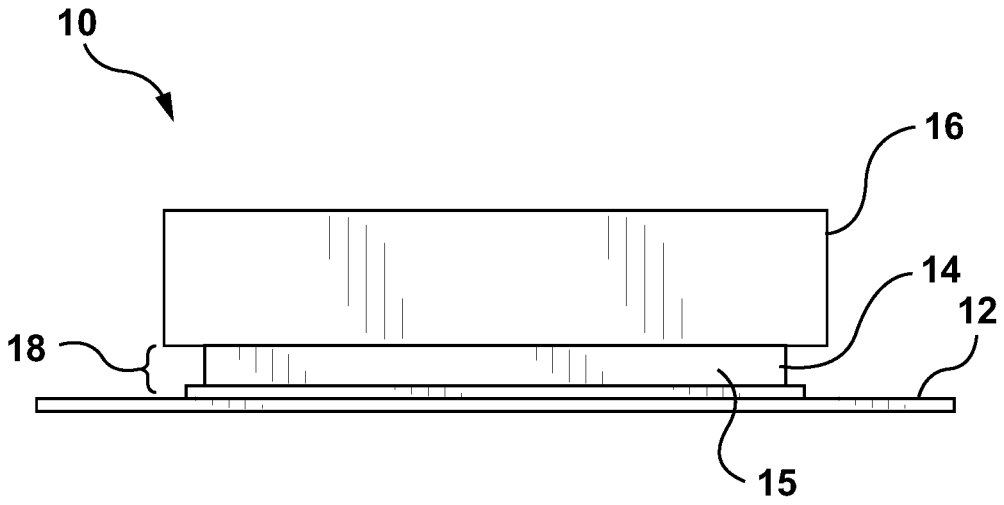
FIG. 2 is a side view of the roof vent shown in FIG. 1.
Figure 3:
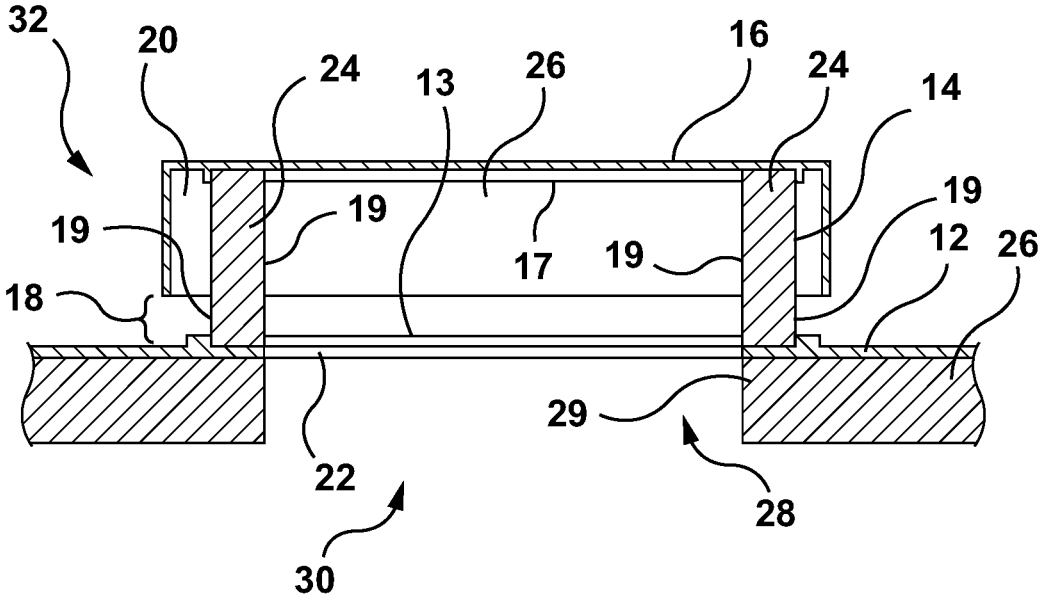
FIG. 3 is a cross sectional view of the roof vent shown in FIG. 2.
Figure 4:
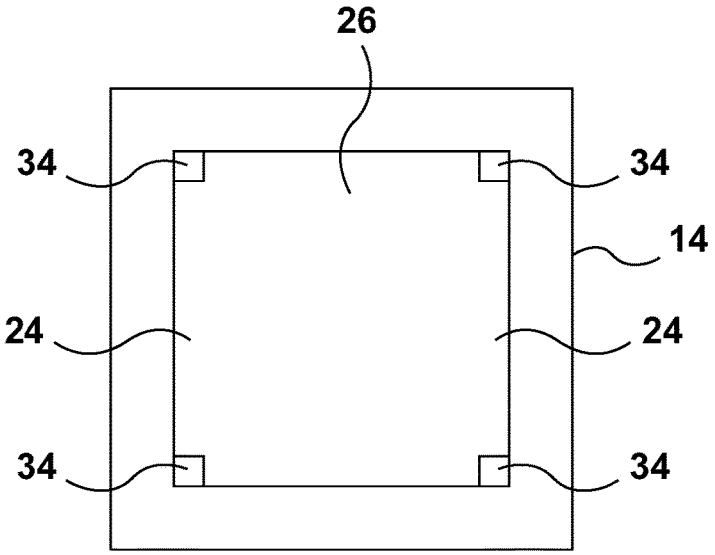
FIG. 4 is a top view of an optional collar portion of the roof vent shown in FIG. 1.
Figure 5:
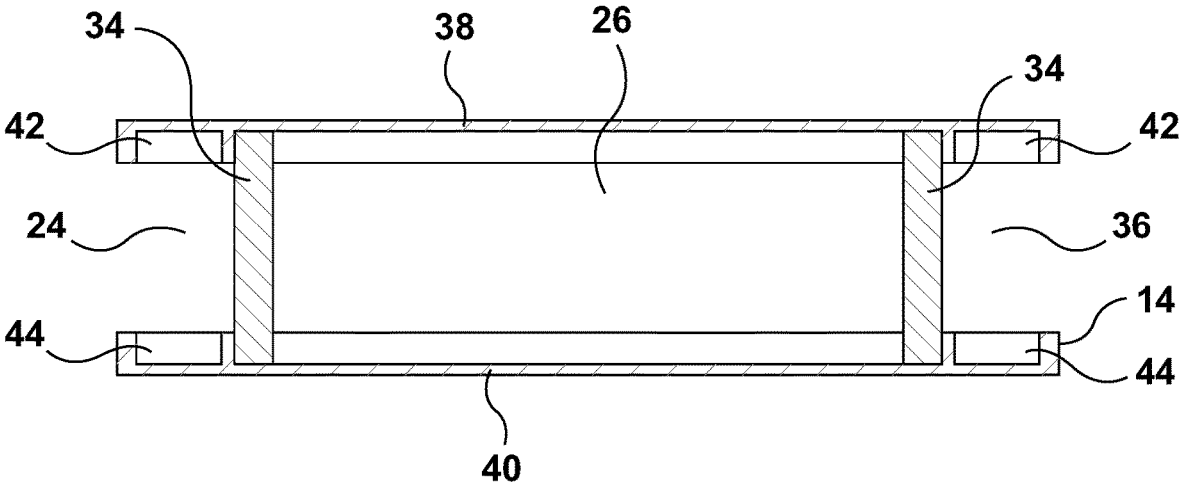
FIG. 5 is a cross sectional view of the collar portion shown in FIG. 4.

Referring now to FIGS. 2 and 3, flange portion 12 has a (e.g. central) aperture 22 and collar portion 14 has a (e.g. central) cavity 26 which communicates with aperture 22 providing for air to circulate between attic interior 30, through hole 28 in roof 26 and cavity 26. Collar/frame 14 can have one or more apertures 24 through which air can circulate between cavity 26 and outside atmosphere 32 through air passage 20 and a gap 18 (between the flange portion 12 and the cap 16). As can be seen in FIGS. 4 and 5, collar portion 14 can be formed as a (e.g. annular) frame having upper portion 38, lower portion 40 and sides 36 formed from support members 34. Apertures 24 are formed between support members 34. The collar portion 14 is one example of a frame (e.g. frame portion 14) that can provide for structural rigidity between the cap 16 and flange portion 12, thus providing for structural integrity of the roof vent 10 in keeping the cap 16 at a spaced apart distance from the flange portion 12. It is also recognized that the frame portion 14 can be separate from the corrugated filter material 46 (e.g. the frame portion 14 and the corrugated filter material 46 are separate and distinct pieces of the roof vent 10). It is also recognized that the frame portion 14 can be integrated with the corrugated filter material 46 (e.g. the frame portion 14 and the corrugated filter material 46 are an integrated component of the roof vent 10). For example, the frame portion 14 with integrated corrugated filter material 46 can be attached to both the cap 16 and the flange portion 12, such that the frame portion 14 extends away (e.g. upwardly, downwardly, etc.) from the respective surfaces 13, 17. As such, the frame portion 14 and the collar portion 14 can be used interchangeably, however recognizing that the frame portion 14 can refer only to the support portions keeping the cap 16 spaced apart from the flange portion 12, while any solid walls transverse to the flange portion 12 are absent from the frame portion 14 (see FIG. 3). In terms of the collar portion 14, this can have both the support portions from holding the cap 16 spaced apart from the flange portion 12 as well as have the upstanding walls transverse to the flange portion 12 (see FIG. 2). As further discussed below, the shield 80 (see FIG. 20) can be used to direct running water away from the roof vent 10 having the optional collar portion 14 (see FIG. 2) having the upstanding walls surrounding the hole 28 in the roof. Alternatively, as further discussed below, the shield 80 (see FIG. 20) can be used to direct running water away from the roof vent 10 having the frame portion 14 (see FIG. 2) not having the upstanding walls surrounding the hole 28 in the roof.

Referring again to FIG. 3, the cavity 26 can form a continuous opening between upper and lower portions 38 and 40, respectively. Upper and lower portions 38 and 40 can have channels 42 and 44, respectively which are opposed (e.g. parallel) to each other and which are dimensioned and configured to receive side edges of corrugated filter plate 46 so that the corrugated filter plate 46 is positioned transversely between interior 26 and aperture 24. Therefore, air passing from the aperture 24 can pass through corrugated filter plate 46 to enter cavity 26. Alternately, the corrugated filter plate 46 is positioned transversely between the atmosphere and the aperture 24.

The corrugated filter plate 46 can be a wire mesh which is corrugated to increase its surface area, thus providing for the passage of air through the surface 19 at a multiple of angles relating to the different surfaces of the folds that are angles to one another. As such, the corrugated surface 19 has a greater surface area as compared to a corresponding planar surface of a side of the roof vent 10 (e.g. a planar cross sectional area of a bounded surface measured between an adjacent pair of support members 34 and the adjacent and opposing surfaces 13, 17). The corrugated filter plate 46 can have a pore 47 size which is selected to inhibit the passage of atmospheric particles, running water and the like through the corrugated filter plate 46, while facilitating the flow of air through the corrugated filter plate 46 from side 19 to side 19. For example, a pore size of approximately 120 microns can inhibit the passage of snow/water while providing for adequate air circulation through the corrugated surface of the filter plate 46, as compared to the planar surface area of a non-corrugated cross sectional area of a side of the roof vent 10 (e.g. covered by a fibrous layer that is non-corrugated—e.g. planar). The material of the corrugated filter plate 46 can be composed of metal, such as but not limited to stainless steel, aluminum, or other materials that can inhibit attachment of the particles (e.g. snow, water) to the corrugated surface 19, when the surface 19 is in an extending orientation (e.g. upwardly, away from, towards, etc.) with respect to the surface(s) 13, 17.

Figure 6:
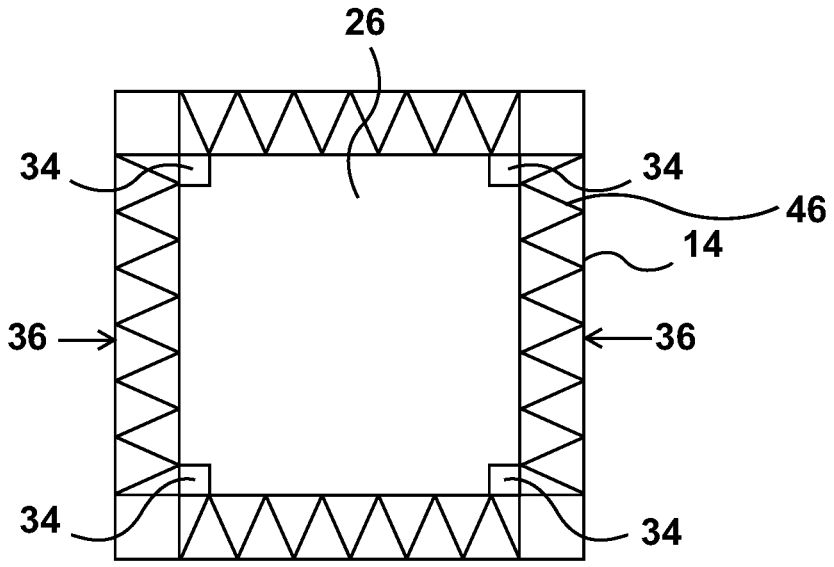
FIG. 6 is a top view of the collar portion with a corrugated filter plate of the roof vent shown in FIG. 1.

Referring back to FIG. 3, collar 14 can extend transverse (e.g. perpendicular) to opening 22. Cap 16 can be dimensioned to close off opening 22 from precipitation and other particles from entering the opening 22 from above. An air passage 20 can be formed between cap 16 and collar portion 14 so that air flows through the side walls of collar 14 and air passage 20 and out gap 18. As mentioned above, collar portion 14 can have the corrugated filter plate 46 (see FIG. 6) mounted thereto so that air flowing from outside vent 10 passes (at least in part) through the corrugated surface 19 of the filter plate 46 before entering opening 22, hole 28 and attic interior 30. Any wind driven snow, water can be trapped between collar 14 and cap 16 and thus be inhibited from infiltrating the attic space 30. Since air passage 20 can be larger than gap 18, a quantity of snow, water can accumulate on the outside of collar 14 while at the same time be inhibited from blocking off the flow of air between exterior 32 (e.g. atmosphere) and attic interior 30. As mentioned previously, the corrugation of filter plate 46 (see FIG. 7) provides for a larger surface area, that what could be achieve by a planar porous layer, positioned about the opening 22, thereby increasing the amount of filter media available to permit air to flow through the filter plate 46. It is recognized that the corrugated filter plate 46 can be of any peripheral shape (e.g. about the periphery 29 of the hole 28), for example square as shown in FIG. 6, as well as any other shape as desired (e.g. circular, oblong, triangular, rectangular, pentagonal), as well as any number of sides (e.g. a square has 4 sides, a triangle has three sides, etc.), as well as any side shape (e.g. linear, arcuate, etc.).

It will be appreciated that numerous modifications can be made to invention without departing from the core of the invention. In particular, the corrugated filter plate 46 can be laid out within the collar portion 14 so that the filter plate 46 lies parallel to opening 22 (e.g. overlapping the opening 22). Certain advantages have been found to a transverse (e.g. perpendicular) arrangement between the filter plate 46 and opening 22 (see FIG. 3). In particular, it is recognized that a perpendicular arrangement can provide for appropriate air circulation through the roof vent 10 while improving the roof vent's 10 ability to block wind driven snow, water from passing through the filter plate 46. In some applications, it can be more cost effective to produce a roof vent 10 where the filter plate is laid out parallel (or some other angle other than perpendicular) relative to the central opening 22.

Figure 8:
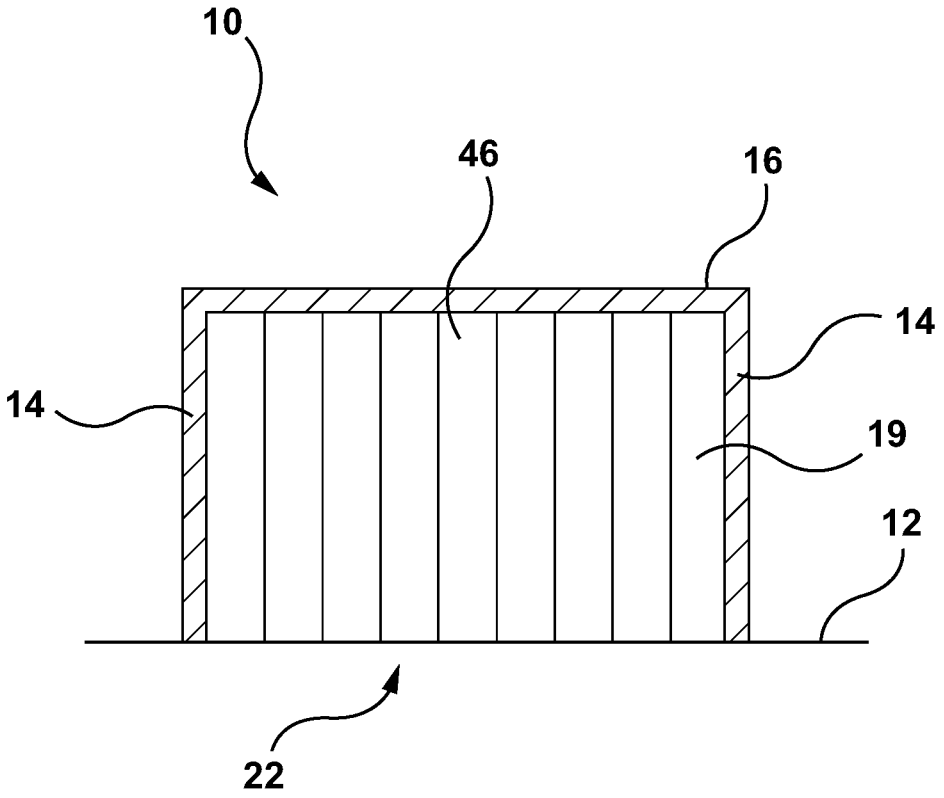
FIG. 8 is an alternative embodiment the cross sectional view of the roof vent shown in FIG. 3.

In view of the above, referring to FIG. 8, shown is an alternative embodiment of the roof vent 10 having a cap 16 (covering opening 22) positioned in a spaced apart relationship with the flange portion 12 by an intervening frame portion 14 (integrated with the filter plate 46, separate from the filter plate 46, etc.), and the corrugated filter plate 46. In this example, the cap 16 does not overlap or otherwise cover the corrugated surface 19 of the filter plate 46, as is shown in FIG. 3. It is recognized that in FIG. 8, a collar sidewall is not shown. As such, it is considered that the collar sidewall (s) can be separate from and thus added to the configuration of a roof vent 10 combination of cap 16, flange portion 12 and corrugated filter plate 46, as desired. For example, the corrugated filter plate 46 can be positioned as a retrofit (e.g. optional insert module to an off-the shelf roofing accessory) into an existing cap 12, frame 14 (e.g. collar portion with or without sidewalls extending from a flange), and flange configured roof vent 10. For example, the flange portion 12 (e.g. with groove) and associated corrugated filter material 46 can be sold as an insert to be combined with an existing cap 16 and/or flange combination roof vent 10.

Figure 9:
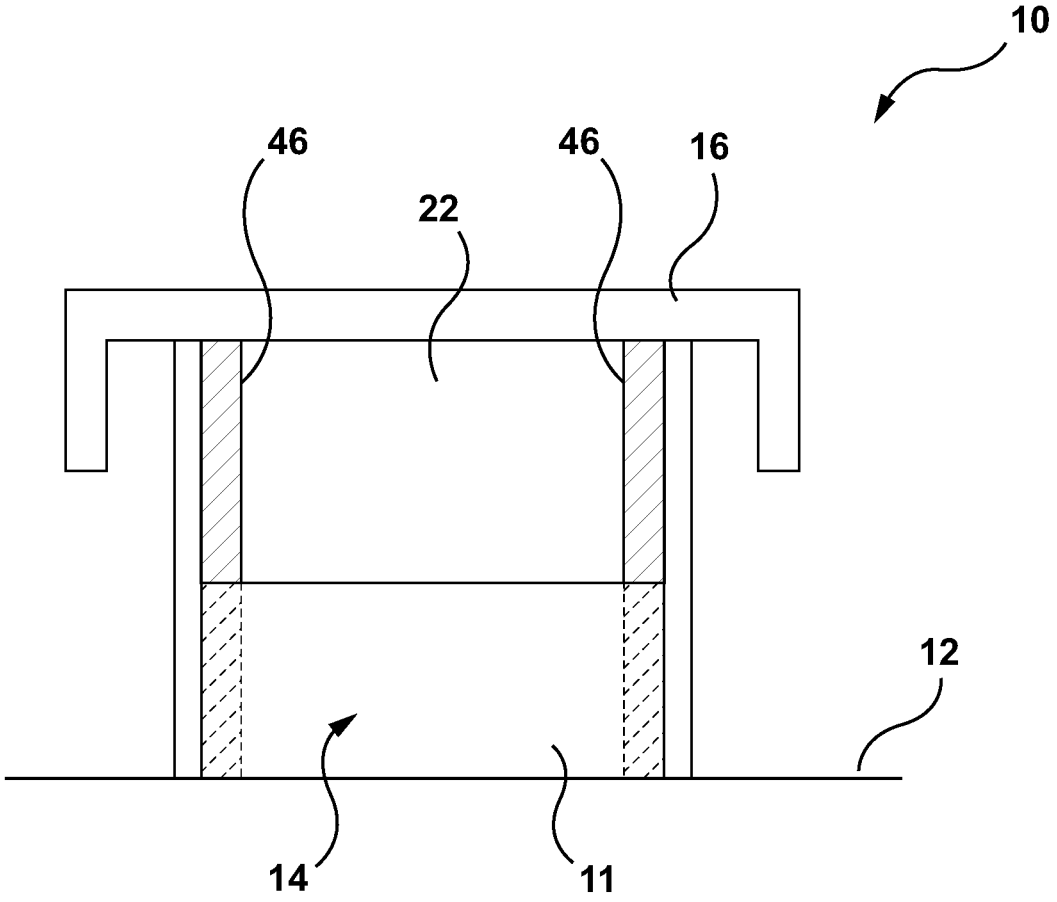
FIG. 9 is a further alternative embodiment the cross sectional view of the roof vent shown in FIG. 3.

Referring to FIG. 9, shown is an alternative embodiment of the roof vent 10 having a cap 16, frame portion 14 including collar sidewalls 11, the flange portion 12, and the corrugated filter material 46 extending between the cap 12 and the flange portion 12, such that the corrugated filter material 46 is positioned between the aperture 22 and the opening 22 (see FIG. 3).

Figure 10:
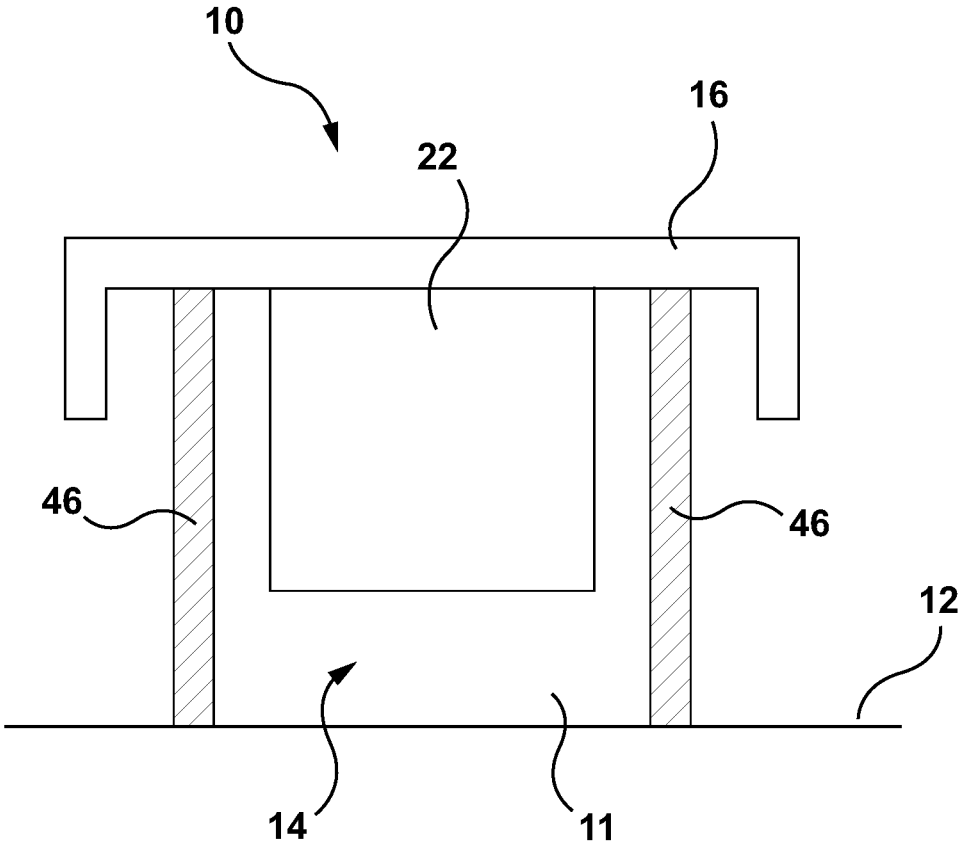
FIG. 10 is a further alternative embodiment the cross sectional view of the roof vent shown in FIG. 3.

Referring to FIG. 10, shown is an alternative embodiment of the roof vent 10 having a cap 16, frame portion 14 including collar sidewalls 11, the flange portion 12, and the corrugated filter material 46 extending between the cap 12 and the flange portion 12, such that the corrugated filter material 46 is positioned between the aperture 22 and the atmosphere.

Figure 11A:
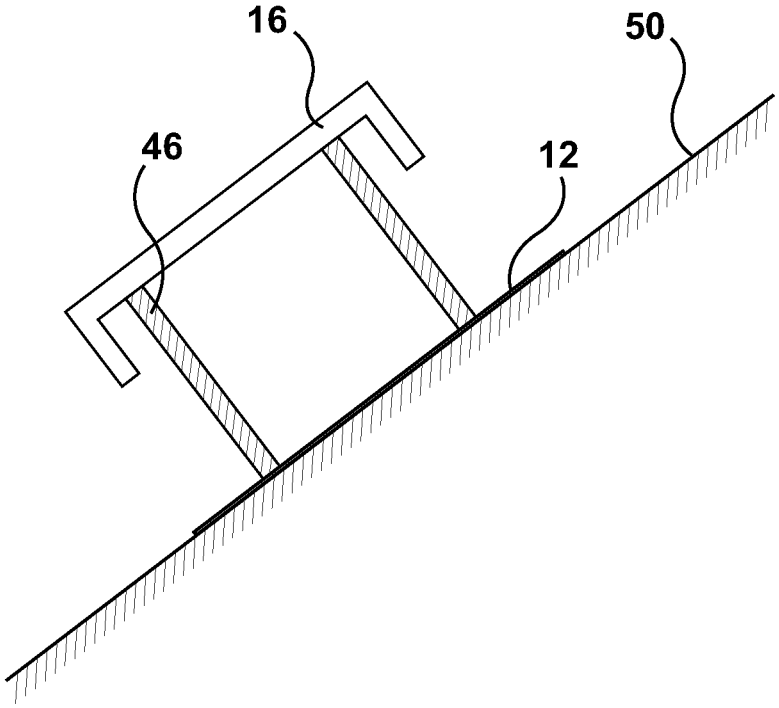
FIG. 11*a* is an alternative embodiment of the roof vent shown in FIG. 1.
Figure 11B:
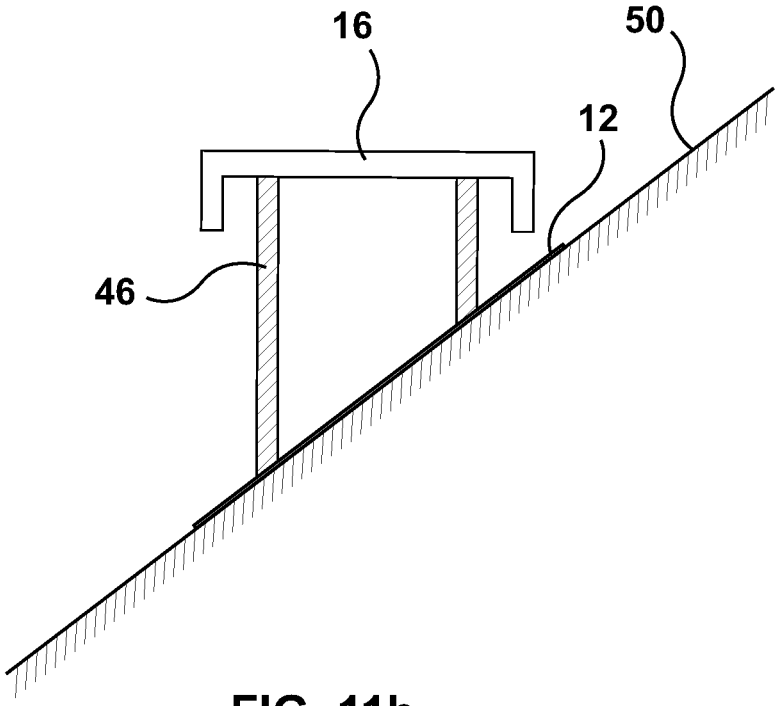
FIG. 11*b* is an alternative embodiment of the roof vent shown in FIG. 1.

Referring to FIG. 11*a*, shown is an alternative embodiment of the roof vent 10 having a cap 16, a flange portion 12, and a corrugated filter material 46 there between, such that the roof vent 10 is positioned non-vertically with respect to a sloped roof surface 50. Referring to FIG. 11*b*, shown is an alternative embodiment of the roof vent 10 having a cap 16, a flange portion 12, and a corrugated filter material 46 there between, such that the roof vent 10 is positioned vertically with respect to a sloped roof surface 50.

Figure 12:
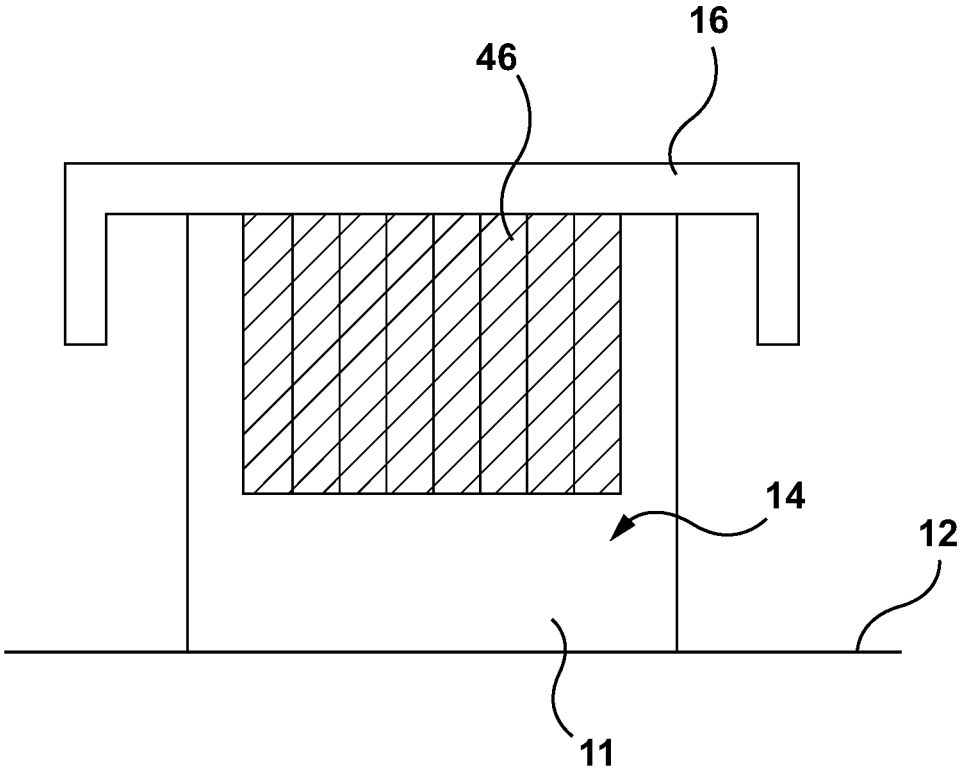
FIG. 12 is a further alternative embodiment the cross sectional view of the roof vent shown in FIG. 3.

Referring to FIG. 12, shown is an alternative embodiment of the roof vent 10 having a cap 16, frame portion 14 including optional collar sidewalls 11, the flange portion 12, and the corrugated filter material 46 extending between the cap 12 and the flange portion 12, wherein the collar sidewalls 11 are positioned between a bottom end of the corrugated filter material 46 and the flange portion 12.

Figure 13:
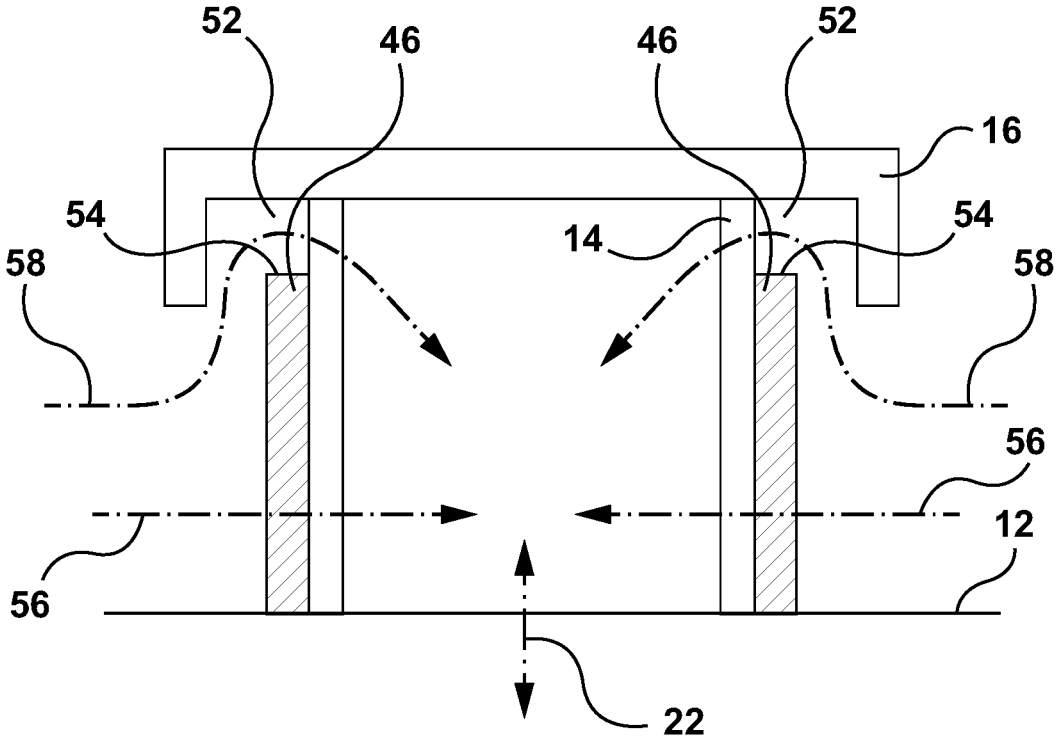
FIG. 13 is a further alternative embodiment the cross sectional view of the roof vent shown in FIG. 3.

Referring to FIG. 13, shown is an alternative embodiment of the roof vent 10 having a cap 16, frame portion 14, the flange portion 12, and the corrugated filter material 46 extending between the cap 12 and the flange portion 12, such that an air gap 52 is positioned between a top 54 (adjacent and spaced apart from surface 17) of the corrugated filter material 46, thus providing for air exchange with the interior via opening 22 both as air passing through 56 the corrugated filter material 46 and bypassing 58 the corrugated filter material 46 by flowing around the top 54 of the corrugated filter material 46 and through the air gap 52.

Figure 14:
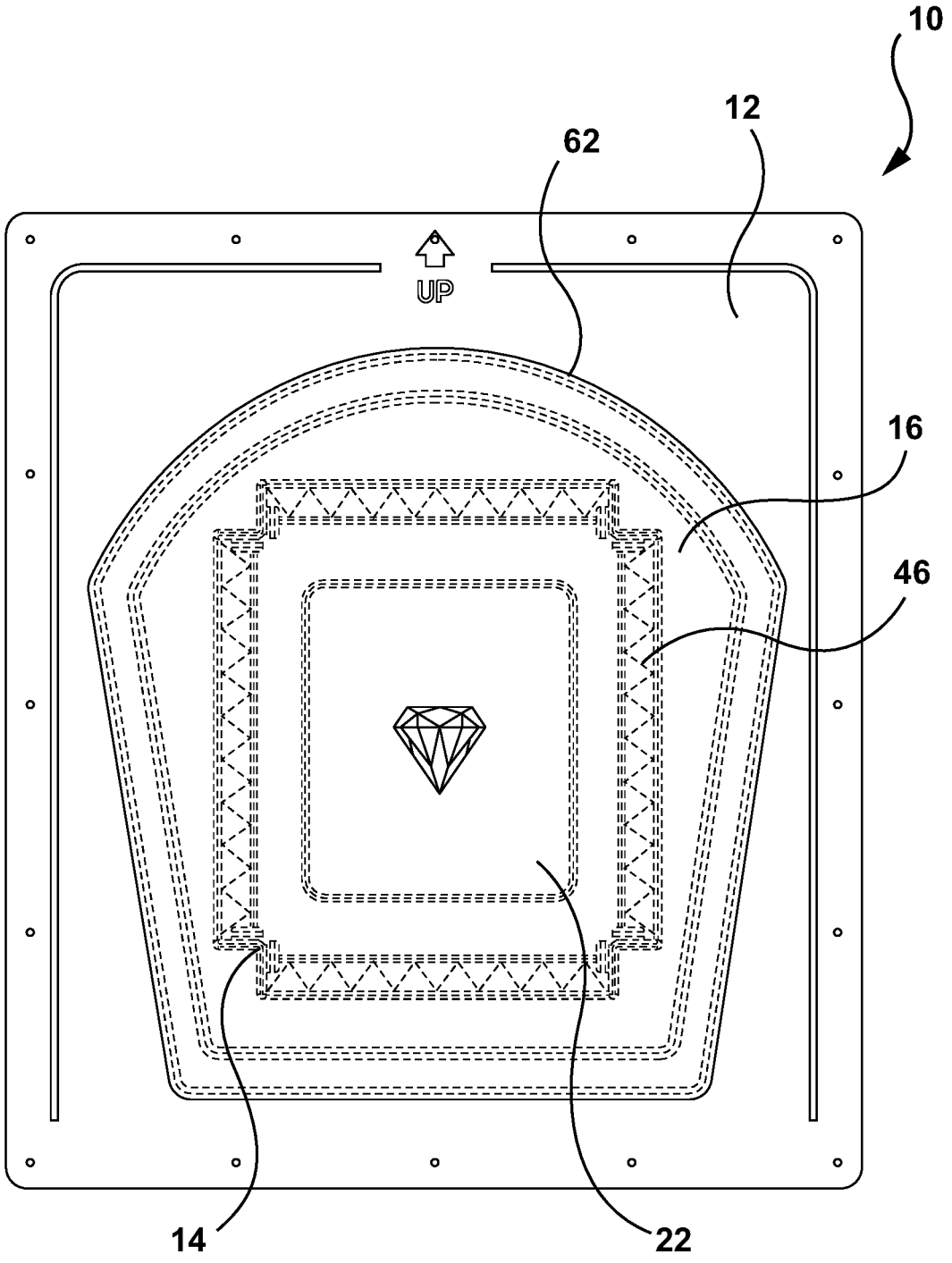
FIG. 14 is an alternative embodiment of the roof vent shown in FIG. 4.
Figure 15:
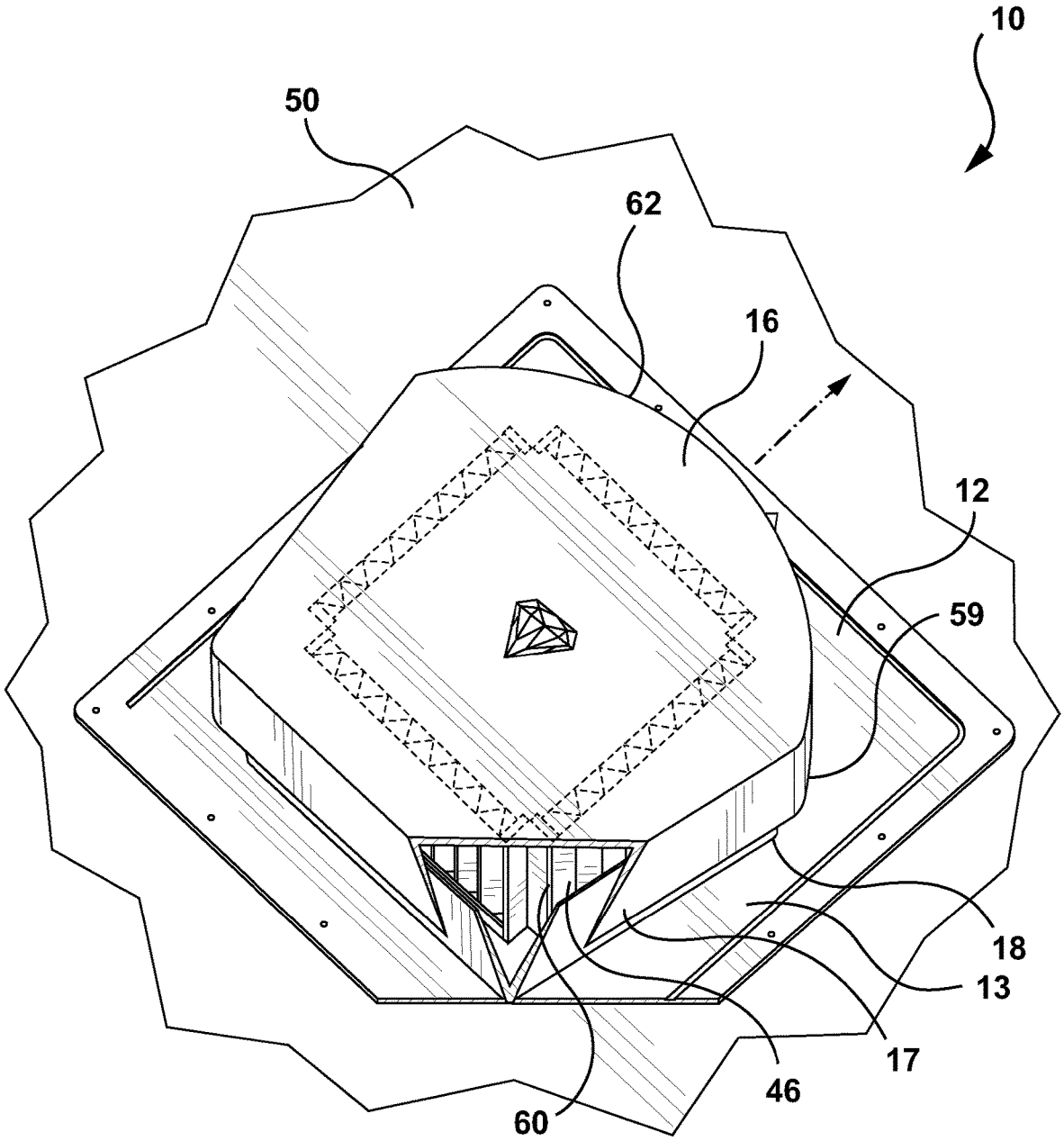
FIG. 15 is a perspective view of the roof vent shown in FIG. 14 with cap attached.
Figure 16:
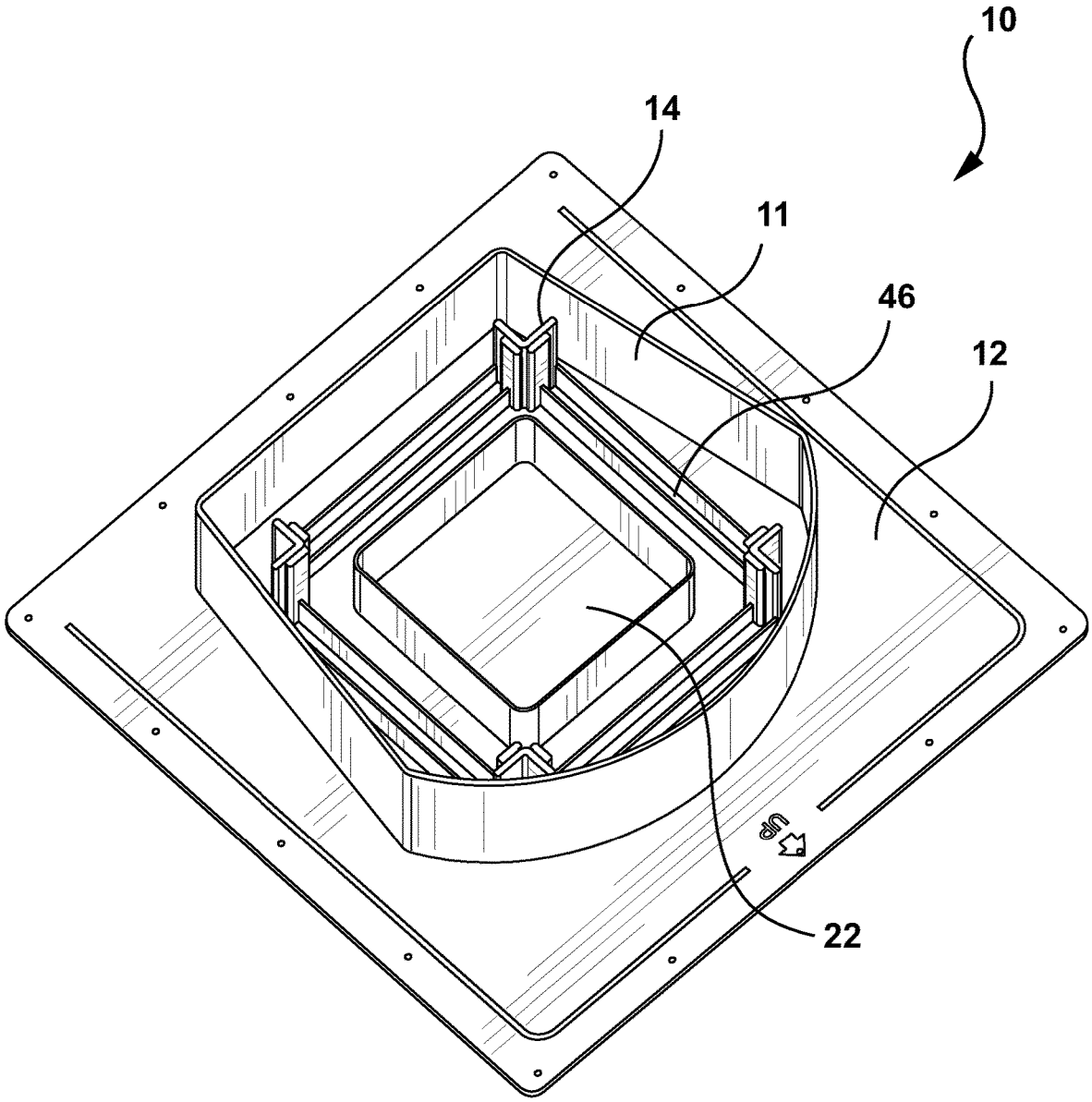
FIG. 16 is a perspective view of the roof vent shown in FIG. 14 without cap attached.

Referring to FIGS. 14, 15, 16 shown is an alternative embodiment of the roof vent 10 as an arch top roof vent having the flange portion 12 (base), an optional collar portion 14 (extends from base including sidewall 11) which also could be referred to as the frame portion 14, and the cap (hood) 16 configured to cover over the corrugated filter material 46. Flange portion 12 is preferably flat to rest flush with the roof 50 to make it easy to install the roof vent 10. Collar portion 14 extends away/upward from flange portion 12. The cap 16 can be dimensioned to enclose much of the collar 14 but to leave a gap 18 between the cap 16 and flange portion 14 to facilitate atmospheric air to pass through the corrugated filter material 46.

The flange portion 14 has an aperture 22 and the collar portion 14 has the cavity which provides for air to circulate into the attic interior via the hole in the roof 50 and cavity of the collar portion 14. The collar portion 14 facilitates the air to circulate between the cavity and the outside atmosphere through the air passage and gap 18. The flange portion 12 can provide support members 14 (illustrated at the four corners) that support the cap 16 above the flange portion 12 and provide clearance between a bottom surface of the cap 16 (e.g. cap arms 59 as an extension of the surface 17) and upper edge 60 (e.g. opposite the flange portion surface 13) of the collar portion 14.

Corrugated filter plates 46 can be positioned between the support members 14. The corrugated filter plate 46 is positioned transversely between interior 22 and atmosphere. Therefore, air passing from atmosphere can pass through filter plate 46 to enter cavity 22. Preferably, a channel can be formed in the flange portion 12 for receiving the filter plate 46.

Illustrated is an arch top design for the optional collar portion walls 11. The cap 16 can be similarly shaped to conform to the collar walls 11 shape to maintain a similarly sized air gap all around the collar portion walls 11. The top edge 62 of the cap 16 (labeled "up" in the drawings) is arcuate (i.e. non-linear) to provide for snow and rain to move away from the top edge 62 to help limit accumulation of the show and/or water as encountered based on the season. The shape of the collar portion wall 11 perimeter can vary but preferably, the top edge can have a curve or arcuate shape to limit accumulation of snow or rain. The perimeter of cap 16 shown in the drawings is trapezoidal but other shapes can include square or diamond so long as the top edge is arcuately shaped.

Figure 17:
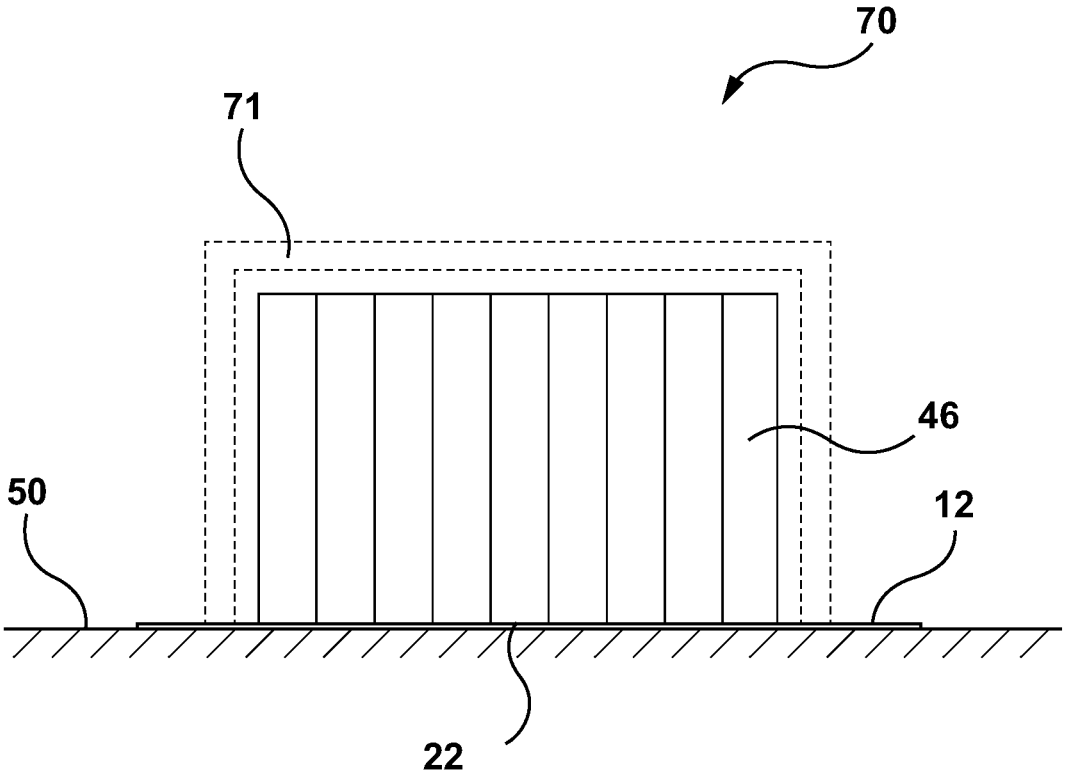
FIG. 17 is an insert as an alternative embodiment of the roof vent shown in FIG. 1.

Referring to FIG. 17 is an insert 70 for an existing roof vent 71 for ventilating a roof of a building via a hole in the roof to atmosphere, the existing roof vent 71 having a cap (shown in ghosted view) for connecting to a flange portion 12, the insert 70 comprising: the flange portion 12 for resting on the roof 50, the flange portion 12 having an opening 22 for overlapping with the hole; and the corrugated filter plate 46 for extending between the cap and the flange portion 12 and interposed transversely between the opening 22 and the atmosphere, the corrugated filter plate 46 providing for a passage of air between the atmosphere and the opening 22, the corrugated filter plate 46 having a pore size sufficient for facilitating the air passage of air through the corrugated filter plate 46 while blocking passage of atmospheric particles through the corrugated filter plate 46.

Figure 18:
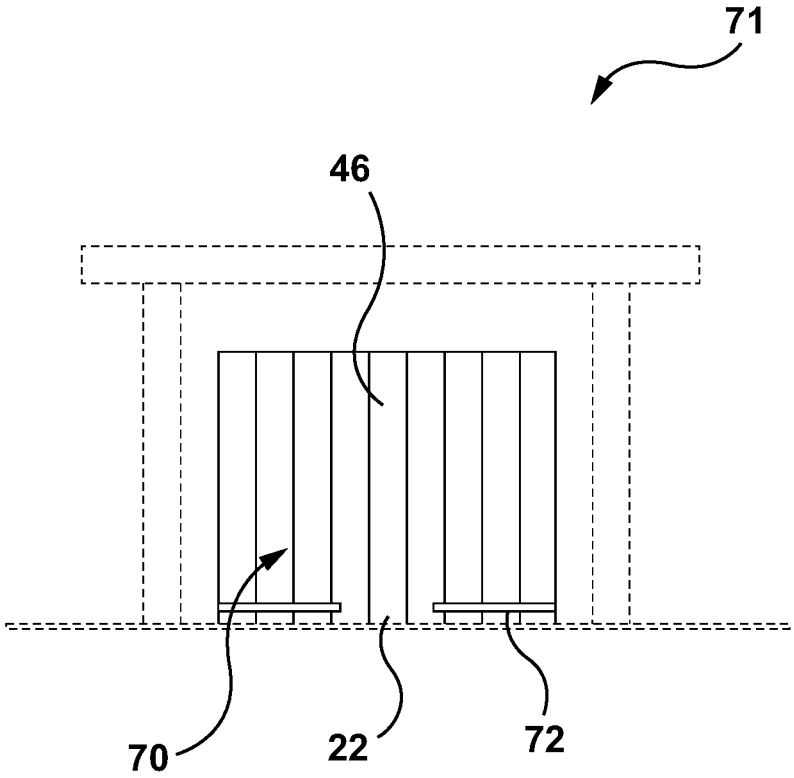
FIG. 18 is an alternative embodiment of the insert of FIG. 17.

Referring to FIG. 18 is an alternative embodiment of the insert 70 for the existing roof vent 71 for ventilating a roof of a building via a hole in the roof to atmosphere, the existing roof vent 71 having a cap connected to a flange portion via a frame portion (shown in ghosted view), the insert 70 comprising: a base 72 for resting on the flange portion, the base having an opening 74 for overlapping with the hole; and a corrugated filter plate 46 positioned on the base 72 for extending between the cap and the flange portion and for being interposed transversely between the opening and the atmosphere, the corrugated filter plate 46 providing for a passage of air between the atmosphere and the opening, the corrugated filter plate 46 having a pore size sufficient for facilitating the air passage of air through the corrugated filter plate 46 while blocking passage of atmospheric particles through the corrugated filter plate 46.

Figure 19:
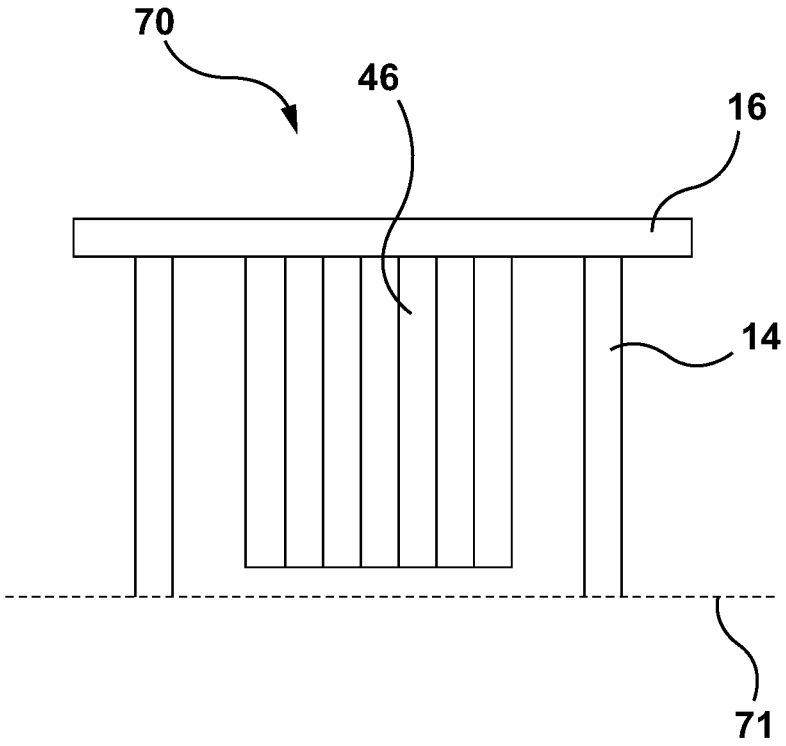
FIG. 19 is a further alternative embodiment of the insert shown in FIG. 18.

Referring to FIG. 19 is an alternative embodiment of the insert 70 for the existing roof vent 71 for ventilating a roof of a building via a hole in the roof to atmosphere, the existing roof vent 71 having a flange portion with an opening (shown in ghosted view) for connecting to a cap 16 via a frame portion 14, the flange portion for resting on the roof and having an opening for overlapping with the hole, the insert 70 comprising: a cap 16 for connecting to the frame portion 14 and covering over the opening; and a corrugated filter plate 46 connected to the cap 16 and for extending between the cap 16 and the flange portion and for interposing transversely between the opening and the atmosphere, the corrugated filter plate 46 providing for a passage of air between the atmosphere and the opening, the corrugated filter plate 46 having a pore size sufficient for facilitating the air passage of air through the corrugated filter plate 46 while blocking passage of atmospheric particles through the corrugated filter plate 46.

It is recognized that the corrugated filter plate 46 can also be referred to as a corrugated filter material 46 or corrugated filter structure 46. It is also recognized that the corrugated filter plate 46 can be provided as a replacement cartridge (to replace a damaged filter plate) for an existing roof vent (e.g. like those shown in FIGS. 17,18,19). The replacement cartridge can include the corrugated filter plate 46 as well as any of the components of the roof vent provided for in the FIGS. 1-19, as desired. For example, 22. the replacement cartridge for an existing roof vent for ventilating a roof of a building via a hole in the roof to atmosphere, the roof vent having a flange portion connected to a cap via a frame portion, the flange portion for resting on the roof and having an opening for overlapping with the hole. The replacement cartridge comprising a corrugated filter plate for connecting with at least one of the flange portion, the cap or the frame portion, the corrugated filter plate for extending between the cap and the flange portion and for interposing transversely between the opening and the atmosphere, the corrugated filter plate providing for a passage of air between the atmosphere and the opening, the corrugated filter plate having a pore size sufficient for facilitating the air passage of air through the corrugated filter plate while blocking passage of atmospheric particles through the corrugated filter plate.

Figure 20:
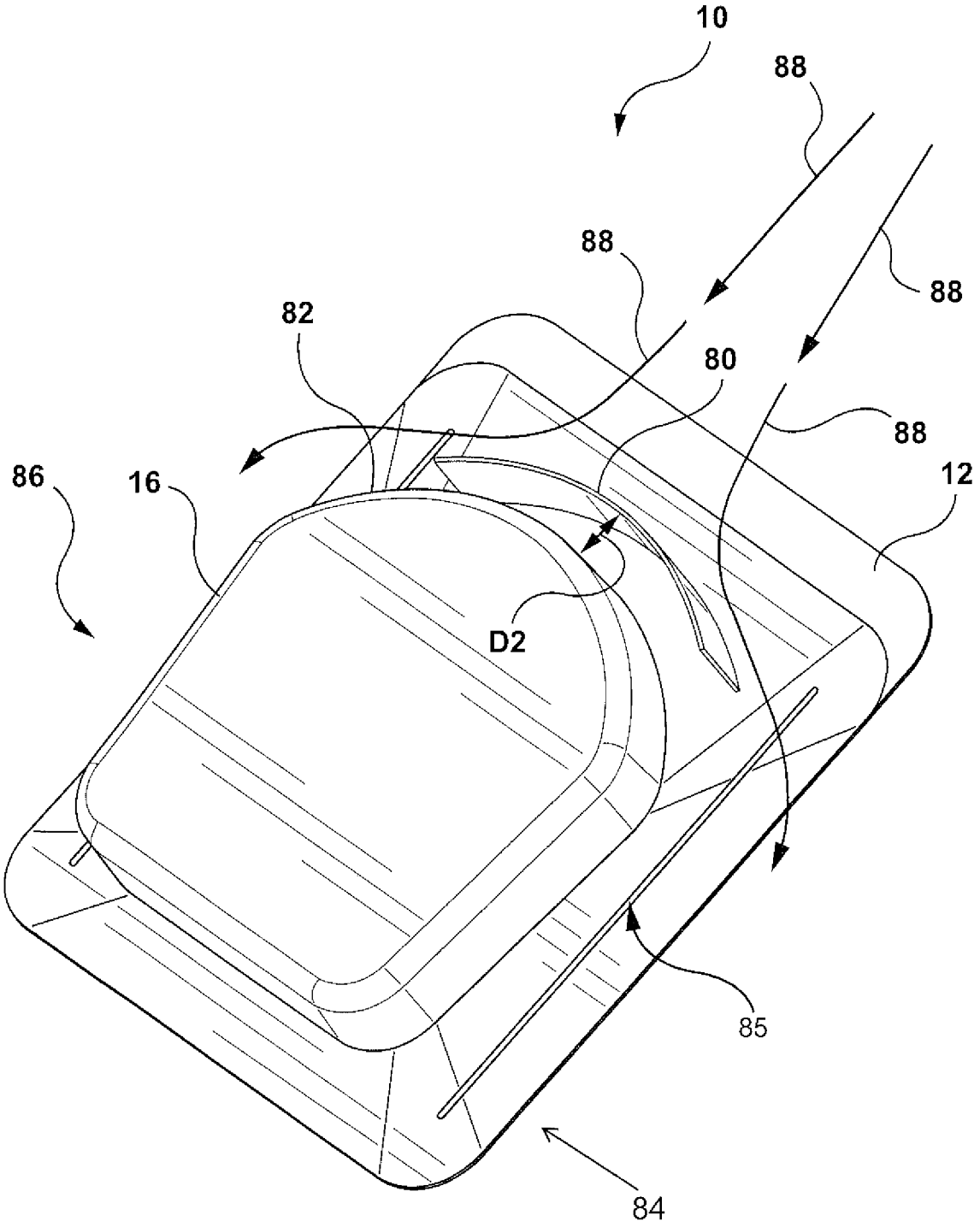
FIG. 20 shows an alternative embodiment of the roof vent of FIG. 1 including an integrated shield
Figure 21:
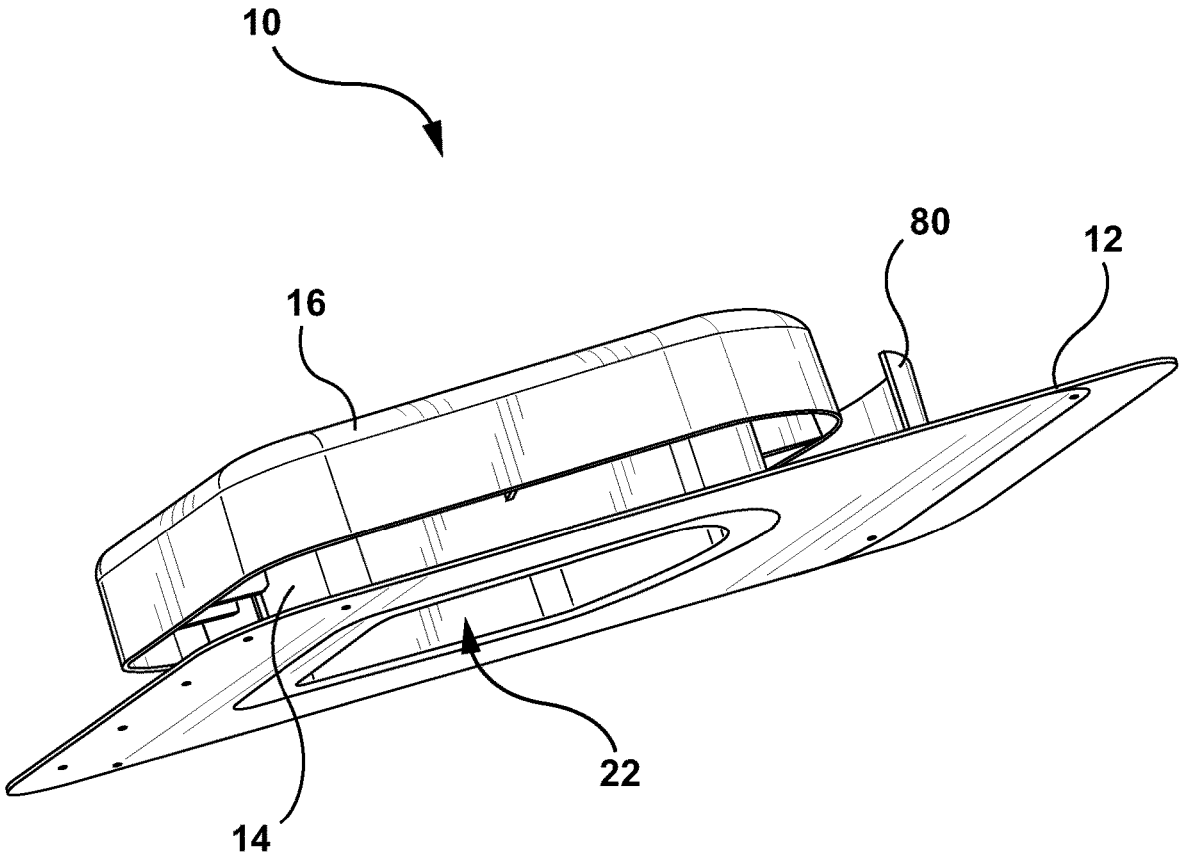
FIG. 21 shows a perspective side view of the vent of FIG. 20.

Referring to FIGS. 20, 21, shown is a further embodiment of the roof vent 10 showing the flange portion 12 to lay against the roof, the flange portion 12 having an opening 22 (see FIG. 22) to let air vent from the interior of the building (e.g. an attic). The roof vent 10 can optionally include a collar portion 14 extending from the flange portion 12 and enclosing, at least in part, about a periphery of the opening 22, and a cap 16 dimensioned and configured to cover over the opening 22 (including the hole 28 in the roof) and optionally over the collar portion 14. The cap 16 is configured to provide a passage (between the flange portion 12 and the cap 16) through which air can pass between the atmosphere and the opening 22. The roof vent 10 can also include a filter plate 46 (see FIG. 14). Also included as mounted (e.g. either as a separate piece or moulded as an integral piece with the flange portion 12) on the flange portion 12 is the shield 80, which can be arcuate in shape as shown in FIG. 20 or other shapes such as linear as shown in FIG. 25*b*. The shield 80 is positioned in front of a leading edge 82 (positionable facing a ridge of the roof) of the roof vent 10 and also spaced apart therefrom. As shown, the shield 80 extends from the flange portion 12 and can be oriented as perpendicular with respect to the flange portion 12. Alternatively, the shield 80 can be oriented at an angle other than 90 degrees with respect to the flange portion 12, e.g. generally transverse with the flange portion 12.

It is recognized that the shield 80 is integrated onto the common flange portion 12 with the roof vent 10 itself. It is important for the shield 80 and the frame/collar portion 14 to be integrated onto the common flange portion 12, as the use of a shared flange portion 12 (between the shield 80 and the frame/colar portion 14) provides for a reduction in the number of auxiliary structures that must be installed (e.g. overlapped) with the roof cladding (e.g. shingles). As such, the installation of the shield 80 and the roof vent 10 itself can be accomplished via the mounting of a single flange portion 12 to the roof. As such, a predefined positioning of the shield 80 adjacent and spaced apart from the roof vent on the common flange portion 12 provides for an integrated shield 80 to be provided with and installed with the roof vent 10. Further, it is advantageous for an installer to not have to measure or otherwise select the positioning of a separate shield on the roof with respect to the roof vent 10 itself. It is recognized that positioning a separate shield (i.e. one not mounted on the flange portion 12 of the roof vent 10 but on the roof itself) too close to the leading side (i.e. oriented towards the peak) of the roof vent 10 can result in undesirable blocking of airflow for that side of the roof vent 10. Further, undesirable accumulation/buildup of snow/ice can occur between the roof vent 10 and the shield, if in the event the separate shield is positioned too close to the roof vent 10. Further, it is recognized that positioning of the separate shield too far from the side of the roof vent 10 (by the installer) can result in water getting between the roof vent 10 and the separate shield, thereby making the separate shield ineffective for directing the running water away from the side of the roof vent 10.

As such, in view of the above, it is desirable and critical to have the shield 80 mounted on the flange portion 10 as an integrated shield 80 positioned a predefined distance apart from the side of the roof vent 10 (i.e. from the frame/collar portion 14 positioned towards the roof peak), for those embodiments of the roof vent 10 intended for placement on the roof in areas where running/voluminous water streams can be expected.

Further, as shown in FIGS. 20 and 25*b*, the shield 80 can extend from one side 84 to the other side 86 of the roof vent 10, such the shield 80 can be any of: 1) a length less than the width of the roof vent 10 between sides 84, 86, 2) a length equal to the width of the roof vent 10 between the sides 84, 86, or 3) a length greater than the width of the roof vent 10 between sides 84, 86. As shown in FIG. 20, the shield 80 deflects rain water 88 to either side 84, 86 of the roof vent 10 as the water runs down the roof surface to which the roof vent 10 is mounted. It is recognized that the shield 80 can be shaped (curved or linear) similar to the shape of the sidewall of the cap portion 16, see FIGS. 20 and 25*b*. Alternatively, the shield 80 shape and the cap portion 16 shape can be different or dissimilar (e.g. linear for the shield 80 and curved for the cap portion 16, curved for the shield 80 and linear for the cap portion 16, etc.). Further, the flange portion 12 can have ridges 85 upstanding from the flange portion 12 adjacent to a periphery (e.g. sides 84,86) of the flange portion 12. The ridges 85 can be positioned on at least two sides 84,86 of the flange portion 12.

Figure 23:
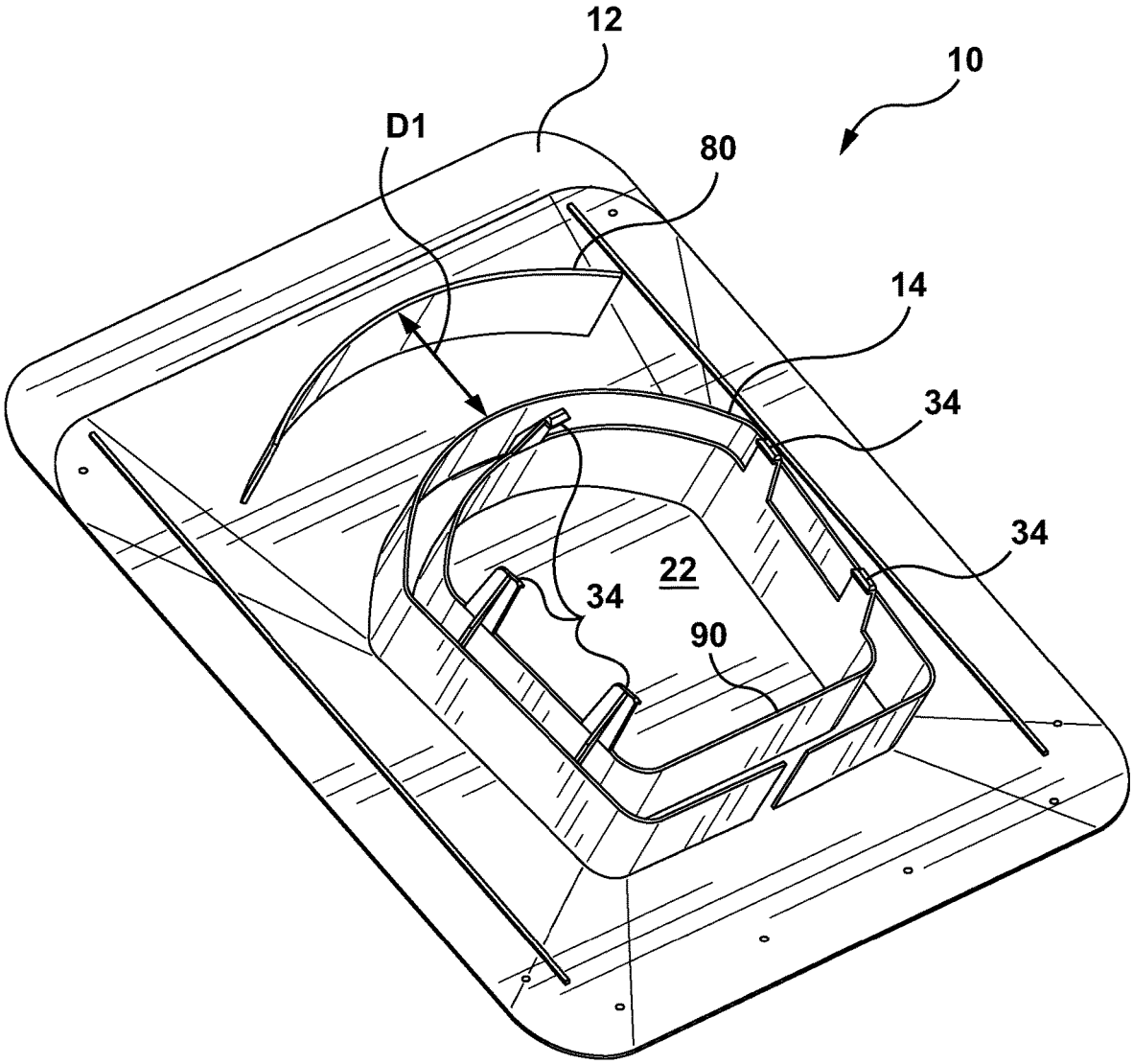
FIG. 23 shows a perspective top view of the vent of FIG. 20 unassembled.

Referring to FIG. 23, the distance D1 between the shield 80 and the frame/collar portion 14 is predefined, such that when the cap portion 16 is positioned on the frame/collar portion 14, the shield 80 is spaced apart by a predefined distance D2 based on the extend of the cap portion 16 sidewalls (see FIG. 20). As discussed, the provision of a predefined distance D1, D2 is important for those applications in which an integrated shield 80 on a common flange portion 12 along with the vent 10 (i.e. collar/frame portion 14 with the cap 16) is desired.

Figure 22:
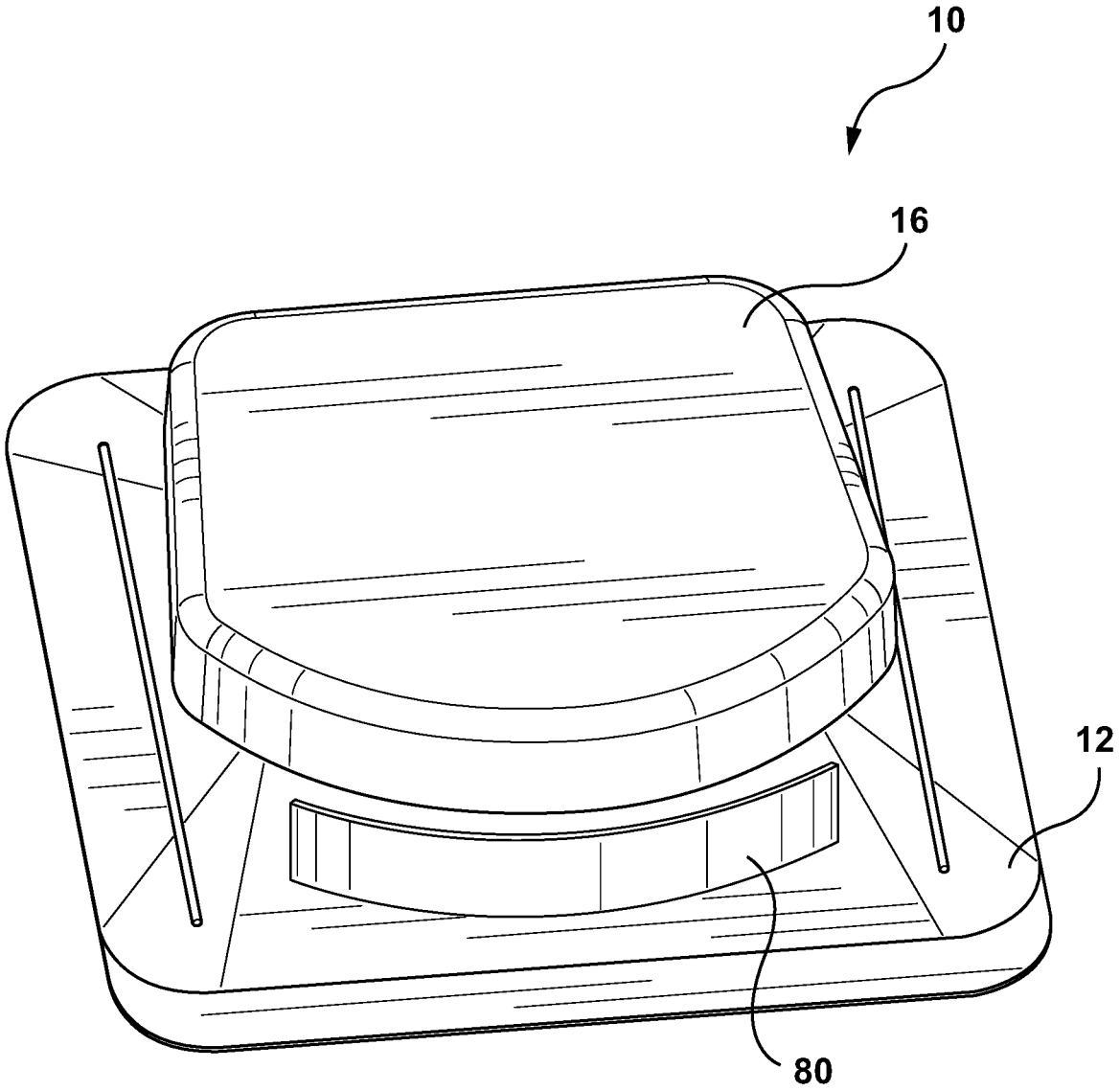
FIG. 22 shows a perspective top view of the vent of FIG. 20.

Referring to FIGS. 22, 23 and 25*b*, the shield 80 can extend from the flange portion 12 by a height equal to a height of the roof vent 10 when fully assembled (e.g. with cap portion 16 thereon). Alternatively, the shield 80 can extend from the flange portion 12 by a height less than a height of the roof vent 10 when fully assembled. Alternatively, the shield 80 can extend from the flange portion 12 by a height greater than a height of the roof vent 10 when fully assembled. For example, as shown in FIG. 23, the shield 80 can extend from the flange portion 12 by a height greater than a height of the collar portion 14 of the roof vent 10. Alternatively, the shield 80 can extend from the flange portion 12 by a height less than a height of the collar portion 14 of the roof vent 10. Alternatively, the shield 80 can extend from the flange portion 12 by a height equal to a height of the collar portion 14 of the roof vent 10. In any event, it is important that the extent(s) (side to side measurement and/or height measurement) is/are matched to the predefined distance D1, D2 as well as the intended mounting position of the roof vent 10 on the roof (in relation to the slope/pitch and/or distance from roof vent 10 to peak). As such, the anticipated amount of snow and/or running water volume can be anticipated base on distance from the apex/peak of the roof as well as the pitch/slope (rise/run) of the roof itself. For example, it is anticipated that roofs of steeper pitch and/or longer distance between the peak and the roof vent 10 location will need taller and/or wider integrate shields 80 as compared to those roofs of shallower pitch and/or lesser distance from roof peak to mounting location of the roof vent 10.

Figure 24:
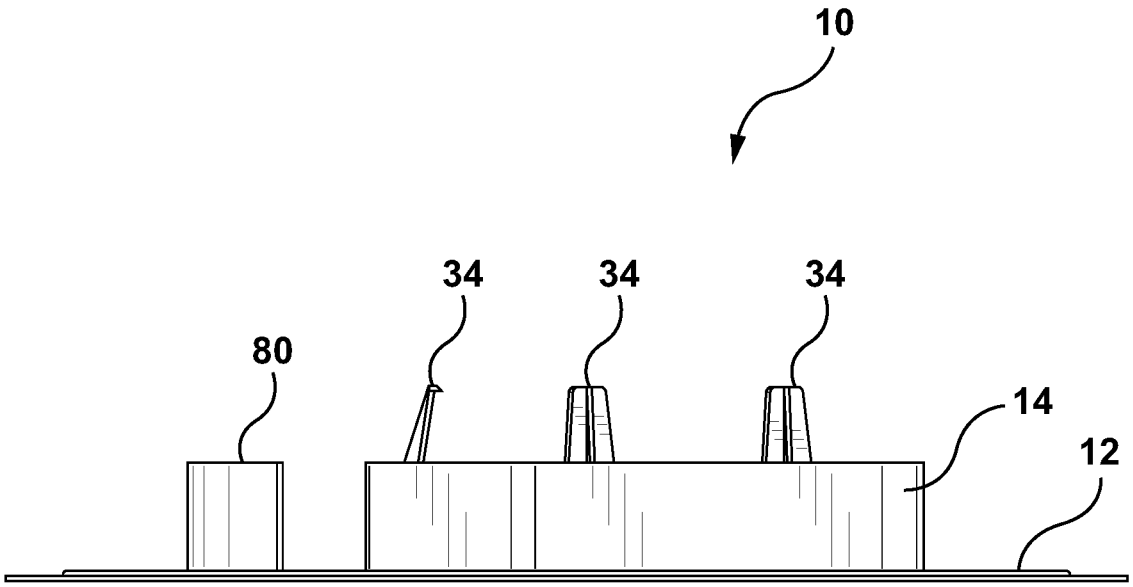
FIG. 24 shows a side view of the vent of FIG. 20 unassembled.
Figure 25A:
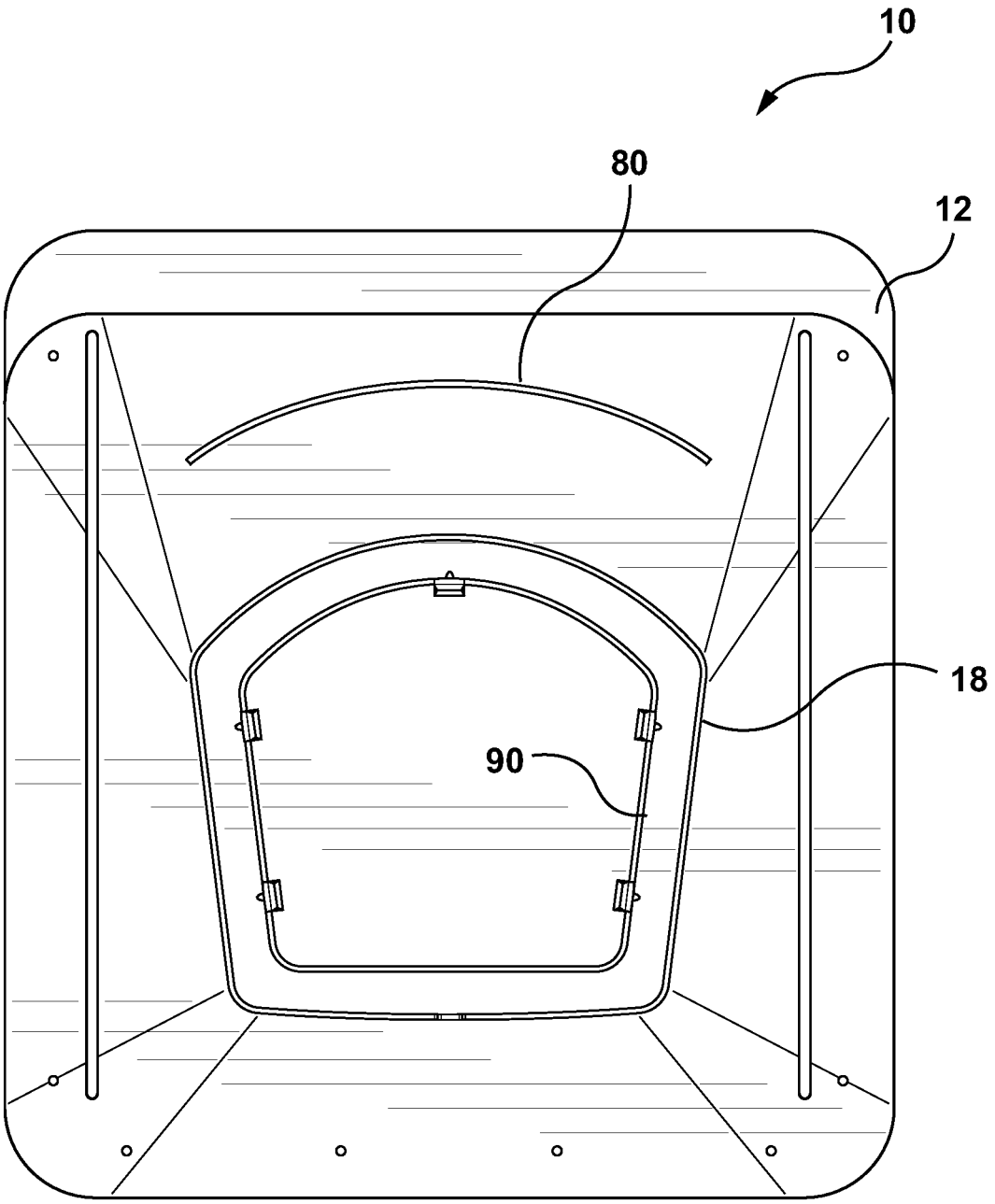
FIG. 25*a* shows a top view of the vent of FIG. 20 unassembled.
Figure 25B:
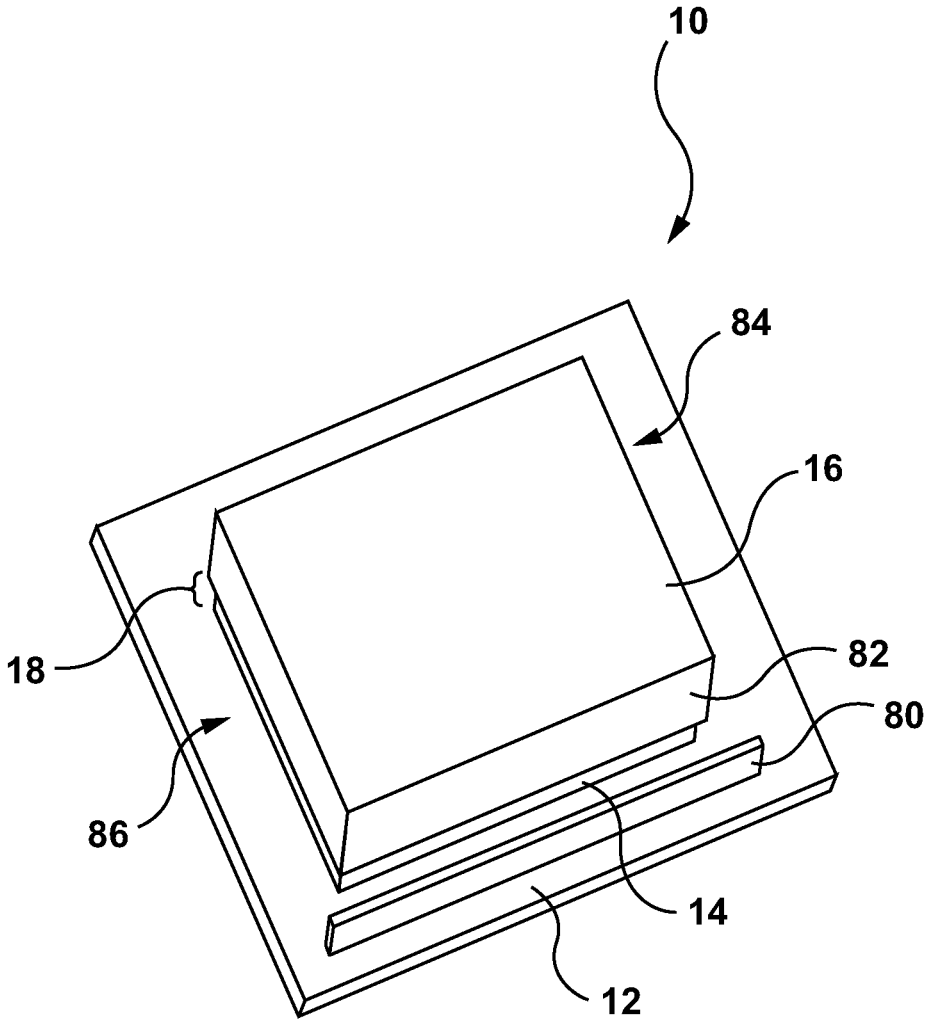
FIG. 25*b* shows a perspective top view of an alternative embodiment of the vent of FIG. 20.

As shown in FIGS. 24 and 25*a*, the roof vent 10 can have an outer collar portion 14 and an inner collar portion 90, such that the inner collar portion 90 and the outer collar portion 14 are spaced apart from one another and extend from the flange portion 12. It is recognized that the collar portion(s) 14, 90 are connected to the flange portion 12 such that a base of the collar portion(s) 14, 90 deflect water from entering the hole 22 in the flange portion 12, i.e. as water runs along the roof and between the cap portion 16 and the flange portion 12, the water is inhibited from entering the hole 22 by the upstanding collar portion(s) 14, 90. As such, the upstanding collar portions are considered upstanding walls or vent deflectors to inhibit water from entering the hole 22 with or without presence of the shield 80 (i.e. the shield when integrated on the flange portion 12 provides enhanced water protection).

Further, it can be appreciated that for larger volumes of water experienced by the roof vent 10, impinging on same as water runoff down the roof during storms, the optional shield 80 can provide for further inhibition of water from penetrating between the cap 16 and the flange portion 12, mounting the collar portion(s) 14, 90, and then entering the hole 22. As such, the shield 80 can be used by the roof vent 10 to deflect at least a portion if not all of the water runoff from contacting the collar portion(s) 14, 90, i.e. acting as a rain water deflector.

As such, in view of the above, it is recognized that in those applications where the integrated shield 80 is desired, the placement of the shield 80 on the flange portion 12 as an integrated shield 80 provides or numerous advantages, such as more efficient installation of the shielded vent 10 by the installer as compared to having to install a separate vent and shield in proximity to one another, potential error in placement of the separate shield in relation to the vent by the installer can be negated in the case of the integrated shield 80, ease of matching the roof vent 10 with integrated shield 10 to the particular roof geometry (e.g. selected roof pitch and distance from roof peak combination) via the integrated roof vent 10 and shield 80 having a predefined distance D1, D2 and predefined shield 80 extent(s), and/or ease of installation with respect to installing of the roof vent 10 with integrated shield 80 with the roof cladding (e.g. overlapping of the shingles with the common flange portion 12 of the roof vent 10 with shield 80).

It is also recognized that it can be disadvantageous to have a separate shield and roof vent, as the roof cladding material installation requirements (e.g. spacings between adjacent shingles, required nailing patters of the shingles, etc.) may not allow for proper placement of the separate shield with respect to the roof vent (i.e. adhering to preferred distances between the separate roof vent and shield for adequate performance of the separate shield).

As such, it is recognized that the roof cladding (e.g. shingles) for the roof vent 10 with integrated shield 80 need not be positioned on top of the flange portion 12 in between the shield 80 and the adjacent frame/collar portion 14. As such, the roof cladding need only be distributed about a periphery of the flange portion 12, for example such that the roof cladding overlaps on top of the opposed side edges (between and connecting the top edge to the bottom edge) of the flange portion 12 and on top of the top edge of the flange portion 12 (e.g. nearest the roof peak), while traditionally the bottom edge (farthest from the roof peak) of the flange portion 12 is positioned over top of the roof cladding. The rest of the top surface (between the side edges and top and bottom edges) of the flange portion 12 can remain exposed (i.e. uncovered by roof cladding) as the roof flange portion 12 can be made out of a weather resistant material such as plastic. Accordingly, the exposed top surface includes the top surface between the integrated shield 80 and the frame/collar portion 14 adjacent and opposed to the integrated shield 80. The benefit of having an exposed top surface of the flange portion 12, especially between the integrated shield 80 and the frame/collar portion 14 adjacent and opposed to the integrated shield 80, is that precise roof cladding placement and resultant fastening (e.g. nails) of the roof cladding to the underlying roof sheathing between the integrated shield 80 and the frame/collar portion 14 adjacent and opposed to the integrated shield 80 can be avoided.

Figure 7:
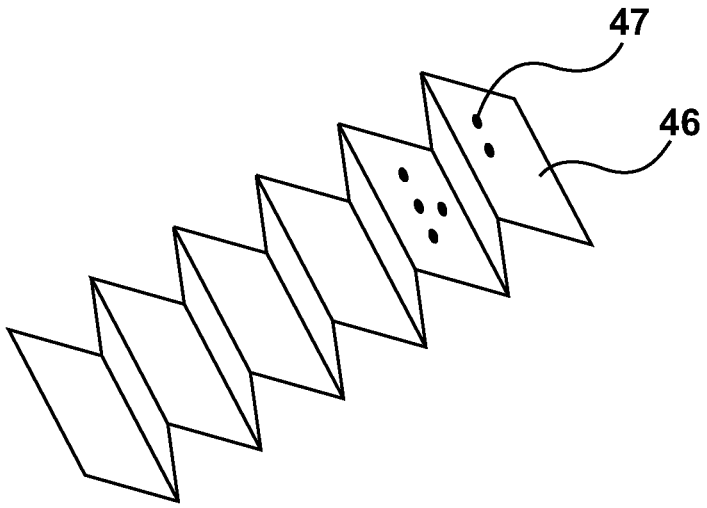
FIG. 7 is a perspective view of a portion of the filter plate portion of the roof vent shown in FIG. 1.
Figure 26:
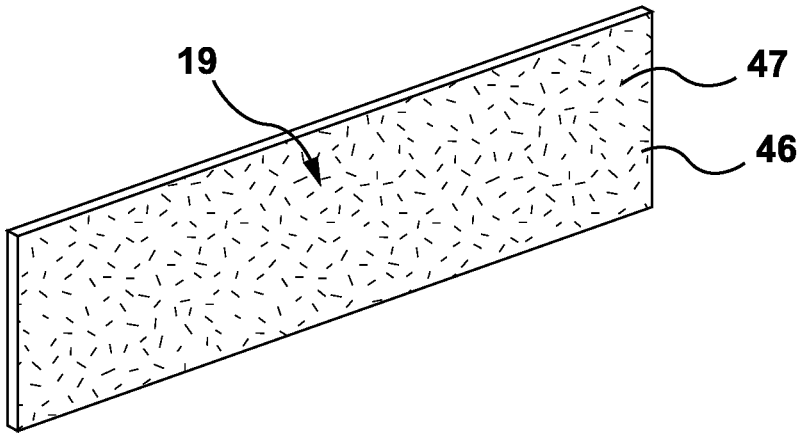
FIGS. 26-27 show alternative embodiments of the filter of FIGS. 6 and 7.
Figure 27:
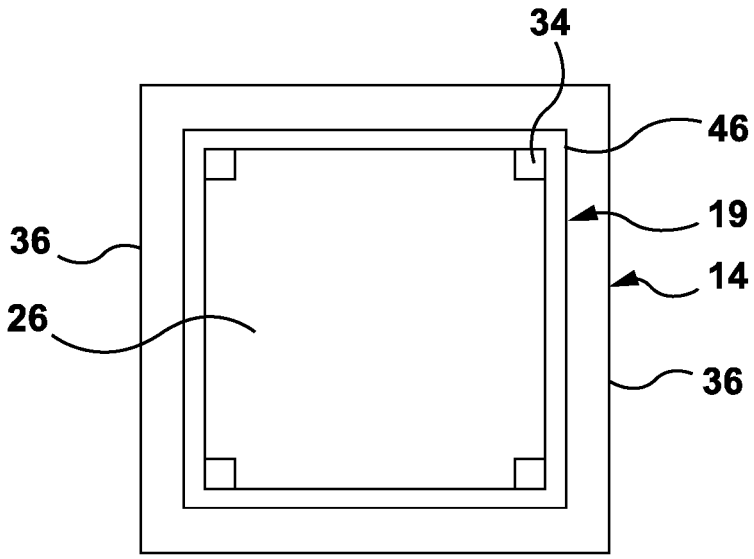

Referring to FIGS. 26 and 27, alternative embodiments of the filter 46 are provided as sheet (e.g. planar) filter portions having the perforations 47 without the corrugations (i.e. creases) shown in FIGS. 6 and 7. As such, the Referring to FIGS. 26 and 27 for the sheet filter 46 version (and other figures as appropriate for other portions of the roof vent 10), the filter plate 46 can have a pore size 47 (e.g. perforations, holes, a plurality of apertures, etc.) sufficient to facilitate air to pass through the filter material 46 (e.g. from one side 19 of the filter material 46 to the other 19) but inhibit the passage of snow particles, cinder particles and/or water droplets there-through (e.g. from one side 19 of the filter material 46 to the other 19). In any event, it is recognized that the purpose of the filter material 46 is to provide for the flow through of air while inhibiting the passage of undesirable particles/droplets (e.g. solid and/or liquid pieces of matter) through the corrugated filter material 46 impinging from the atmosphere and into the interior of the roof via the opening 22 and adjacent hole 28.

For example, the filter material 46 can be positioned as extending upwardly between the flange portion 12 and the cap 16 (covering the opening 22). It is recognized that the filter material 46 can be in contact with a top surface 13 of the flange portion 12, in contact with an underside surface 17 of the cap 16, and/or in contact with the top surface 13 of the flange portion 12 and with the underside surface 17 of the cap 16. It is recognized that a sidewall 15 (e.g. collar wall—see FIG. 2) extending upwardly from the top surface 13 of the flange portion 12 can also be considered as part of the top surface 13 of the flange portion 12. It is recognized that a sidewall (not shown) extending downwardly from the bottom/underside surface 17 of the cap 16 can also be considered as part of the bottom/underside surface 17 of the cap 16.

The sheet configuration of the filter 46 (see FIG. 26) can refer to the absence of draws or bends into folds or alternate furrows and ridges of the surface of the filter plate 46 seen in FIGS. 6 and 7. For example, the filter material 46 (e.g. plate) can be a single walled surface 19 as shown, can be a double walled structure, not shown, (e.g. having a space between adjacent walls having a sheet like surface 19, etc). Preferably the filter material 46 has a sheet (e.g. planar, arcuate, curved, etc.) surface 19 exposed to the passage of air impinging on the filter material 46 from the atmosphere and directed towards the opening 22 (and overlapping hole 28 in the roof membrane of the building) and into the roof cavity (e.g. attic space). Preferably the filter material 46 has a sheet surface 19 exposed to the passage of air impinging on the filter material 46 from the exiting the roof cavity (e.g. attic space) and directed towards the opening 22 (and overlapping hole 28 in the roof membrane 50 of the building) and into the atmosphere.

In terms of positioning of the filter material 46 with respect to the cap 16 (at least covering the opening 28) and with respect to the flange portion 12, the filter material 46 can be positioned transverse to both of the cap 16 (e.g. underside surface 17 of the cap 16) and the flange portion 12 (e.g. upper surface 13 of the flange portion 12). As such, it is recognized that the filter material 46 can be in contact with one of the surfaces 13, 17, with both of the surfaces 13, 17, an/or in contact with none of the surfaces 13, 17 (e.g. suspended between the surfaces 13, 17 by a secondary structure that can also be used to position the cap 16 in a spaced apart relationship with the flange portion 12. For example, the secondary structure can be provided by the collar portion 14 described herein as an example only. In any event, the filter material 46 extends transversely (in whole, in part, etc.) between the cap 16 and the flange portion 12 (e.g. base of the roof vent 10). In terms of in-whole, then any passage of air between the opening 22 and the atmosphere would pass though the body of the filter material 46. Alternatively, in terms of in-part, some of the passage of air between the opening 22 and the atmosphere would pass though the body of the filter material 46 and passage of air between the opening 22 and the atmosphere would go around the body of the filter material 46. In terms of transverse, this can be referred to as situated or lying across (e.g. between the opposing surfaces 13, 17), lying sideways (e.g. between the opposing surfaces 13, 17), crosswise (e.g. between the opposing surfaces 13, 17), crossing from side to side (e.g. between the opposing surfaces 13, 17), athwart (e.g. between the opposing surfaces 13, 17), crossways (e.g. between the opposing surfaces 13, 17), lying or extending across or in a cross direction (e.g. between the opposing surfaces 13, 17), cross (e.g. between the opposing surfaces 13, 17). One example of transverse (e.g. between the opposing surfaces 13, 17) can be lying at right angles to or perpendicular to each or both of the opposing surfaces 13, 17). It is also recognized that the angle of the filter material 46, when extending away from (either in or out of contact with the actual surface 13, 17) the surface 13, 17, can be other than 90 degrees, as desired.

In terms of the net free cross sectional area for the passage of air through the filter plate 46, the aggregate total open area (e.g. summation of the effective open area of each of the individual pore 47 cross sectional areas) of the plurality of holes/pores 47 can be configured to satisfy a minimum net open area threshold. For example, the open area threshold can be approximately 50 square inches of flow ability (e.g. net free area) available for the passage of air to flow through. It is recognized that the minimum net open area threshold can be a standard defined threshold, different for each country, province, and/or state based building codes/standards. In an example where the filter plate 46 does not extend from surface 13 to surface 17, the total net free air flow area available would be the aggregate of the effective open area of each of the individual pore 47 cross sectional areas of the filter plate 46 and the open cross sectional area of an air gap between an end of the filter plate 46 and the adjacent surface 13, 17.

Referring to FIG. 1-27, the roof vent 10 provides for roof ventilation while at the same time inhibiting the infiltration of snow (e.g. undesired particles) into the attic. The roof vent 10 has the flange portion 12, optionally the collar portion 14 (shown as an example embodiment) and the cap 16 configured to cover over (e.g. most) of the collar portion 14 and to cover over a portion of the surface 19. Flange portion 12 is preferably flat to rest flush with the roof (not shown) to make it easy to install the roof vent. Collar portion 14 extends perpendicularly upward from flange 12. Cap 16 can be dimensioned to enclose much of the collar portion 14 but to leave a space gap 18 between the cap 16 and flange portion 12 to permit atmospheric air to pass through collar portion 14.

It is also recognized that the frame portion 14 can be integrated with the filter material 46 (e.g. the frame portion 14 and the filter material 46 are an integrated component of the roof vent 10). For example, the frame portion 14 with integrated filter material 46 can be attached to both the cap 16 and the flange portion 12, such that the frame portion 14 extends away (e.g. upwardly, downwardly, etc.) from the respective surfaces 13, 17.

Referring again to FIGS. 26 and 27, as such, the sheet surface 19 can have a similar surface area as compared to a corresponding planar surface of a side of the roof vent 10 (e.g. a planar cross sectional area of a bounded surface measured between an adjacent pair of support members 34 and the adjacent and opposing surfaces 13, 17). The filter plate 46 can have a pore 47 size which is selected to inhibit the passage of atmospheric particles (e.g. snow particles) through the filter plate 46, while facilitating the flow of air through the filter plate 46 from side 19 to side 19. For example, a pore size of approximately 120 microns can inhibit the passage of snow while providing for adequate air circulation through the non-corrugated surface of the filter plate 46. The material of the filter plate 46 can be composed of metal, such as but not limited to stainless steel, aluminum, or other materials that can inhibit attachment of the particles (e.g. snow) to the sheet/plate surface 19, when the surface 19 is in an extending orientation (e.g. upwardly, away from, towards, etc.) with respect to the surface(s) 13, 17.

As such, it is recognized that any of the roof vent 10 embodiments shown in FIGS. 1-27 can have a corrugated version of the filter plate 46, a non-corrugated (e.g. sheet/plate) version of the filter plate 46, or a combination (e.g. one or more of the sides of the roof vent 10) can have different respective ones of the corrugated and the non-corrugated filters 46 (i.e. a mixture of corrugated and non-corrugated to provide for further inhibition of water penetration into the hole 22). For example, in terms of a mixture of filter types, the roof peak facing side of the roof vent 10 could have a sheet configured filter plate 46 (of FIG. 26) while the other sides (i.e. opposed side to the peak facing side and the sides there-between) could have the corrugated filter type (see FIG. 6). For example, in terms of a mixture of filter types, the roof peak facing side of the roof vent 10 could have a corrugated configured filter plate 46 (of FIG. 6) while the other sides (i.e. opposed side to the peak facing side and the sides there-between) could have the non-corrugated filter type (see FIG. 26). It is recognized that other alternative mixed type configurations are contemplated.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

I claim:

1. A roof vent for ventilating a roof of a building via a hole in the roof to atmosphere, the roof vent comprising:

a flange portion configured to rest on the roof, the flange portion having an opening configured to overlap the hole, and a ridge upstanding from the flange portion, the ridge positioned on at least two sides of the flange portion adjacent to a periphery of the flange portion;

a frame portion configured to maintain a cap portion in a spaced apart relationship with the flange portion; the cap portion connected to the frame portion and covering over the opening; and an integrated shield mounted on the flange portion and extending transverse to the flange portion on a respective said side of the flange portion and configured to face a peak of the roof, the integrated shield upstanding from the flange portion and spaced apart from the frame portion by a predefined distance and configured for deflecting water running down the roof to either side of the roof vent, the integrated shield positioned between the ridge and the cap portion.

2. The roof vent of claim 1 further comprising a corrugated or non-corrugated filter plate extending between the cap portion and the flange portion and interposed transversely between the opening and the atmosphere, the corrugated or non-corrugated filter plate providing for a passage of air between the atmosphere and the opening, the corrugated or non-corrugated filter plate having a pore size sufficient for facilitating the air passage of air through the corrugated or non-corrugated filter plate while blocking passage of water through the corrugated or non-corrugated filter plate.

3. The roof vent of claim 1, wherein a height of the integrated shield with respect to the flange portion is less than a height of a top of the cap portion measured from the flange portion.

4. The roof vent of claim 1, wherein a height of the integrated shield with respect to the flange portion is greater than a height of a top of the cap portion measured from the flange portion.

5. The roof vent of claim 1, wherein a height of the integrated shield with respect to the flange portion is equal to a height of a top of the cap portion measured from the flange portion.

6. The roof vent of claim 1, wherein a width: of the integrated shield from side to side is less than a width of the cap portion adjacent to the integrated shield.

7. The roof vent of claim 1, wherein a width of the integrated shield from side to side is greater than a width el the cap portion adjacent to the integrated shield.

8. The root vent of claim 1, wherein a width of the integrated shield from side to side is equal to a width of the cap portion adjacent to the integrated shield.

9. The roof vent of claim 1, wherein a shape of the integrated shield is different to the cap portion adjacent to the integrated shield.

10. The roof vent of claim 1, further comprising the frame portion having an upstanding collar wall portion extending from the flange portion, the upstanding wall portion extending about a periphery of the hole.

11. The roof vent of claim 1, wherein when installed on the roof a top surface area of the flange portion between the integrated shield and the frame portion adjacent and opposed to the integrated shield is uncovered by roof cladding material and thus exposed to the atmosphere.

12. The roof vent of claim 1, further comprising the frame portion having an upstanding collar wall portion extending from the flange portion, the upstanding wall portion extending at least a portion of a periphery of the hole.

13. The roof vent of claim 12 further comprising the frame portion positioned within the upstanding collar portion.

14. The roof vent of claim 1, wherein a shape of the integrated shield is similar to the cap portion adjacent to the integrated shield.

15. The roof vent of claim 14, wherein the shape is linear.

16. The roof vent of claim 14, wherein the shape is curved.

* * * * *